US012215948B2

(12) United States Patent
Noonan et al.

(10) Patent No.: US 12,215,948 B2
(45) Date of Patent: Feb. 4, 2025

(54) FIREARM

(71) Applicant: Firearm Consulting Group, LLC, Boise, ID (US)

(72) Inventors: Paul T. Noonan, Boise, ID (US); Dean Earl Sylvester, Boise, ID (US)

( * ) Notice: Subject to any disclaimer, the term of this patent is extended or adjusted under 35 U.S.C. 154(b) by 0 days.

(21) Appl. No.: 17/490,061

(22) Filed: Sep. 30, 2021

(65) Prior Publication Data

US 2022/0018619 A1 Jan. 20, 2022

Related U.S. Application Data

(63) Continuation of application No. 16/746,909, filed on Jan. 19, 2020, now Pat. No. 11,162,748.

(60) Provisional application No. 62/794,643, filed on Jan. 20, 2019.

(51) Int. Cl.
*F41A 3/66* (2006.01)
*F41A 11/02* (2006.01)

(52) U.S. Cl.
CPC ..... *F41A 3/66* (2013.01); *F41A 11/02* (2013.01)

(58) Field of Classification Search
CPC ..... F41A 3/66; F41A 3/78; F41A 3/80; F41A 3/82; F41A 3/88; F41A 11/02; F41A 11/04; F41C 23/04
See application file for complete search history.

(56) References Cited

U.S. PATENT DOCUMENTS

| | | | | |
|---|---|---|---|---|
| 2,437,548 | A * | 3/1948 | George | F41C 27/18 89/194 |
| 8,955,422 | B1 * | 2/2015 | Schumacher | F41A 25/10 89/193 |
| 9,528,793 | B1 * | 12/2016 | Oglesby | F41C 27/00 |
| 9,829,272 | B2 * | 11/2017 | Brown | F41C 23/04 |
| 9,857,136 | B2 * | 1/2018 | Hayes | F41A 3/12 |
| 10,323,891 | B1 * | 6/2019 | Zheng | F41A 3/84 |
| 10,422,595 | B2 * | 9/2019 | Law | F41A 3/82 |
| 10,605,553 | B1 * | 3/2020 | Collazo | F41C 7/00 |
| 2012/0137563 | A1 * | 6/2012 | Ubl | F41A 21/48 42/75.03 |
| 2015/0369555 | A1 * | 12/2015 | Daniel | F41A 21/487 42/75.02 |
| 2018/0142981 | A1 * | 5/2018 | Collazo | F41A 9/55 |
| 2018/0224227 | A1 * | 8/2018 | Durham, III | F41A 3/26 |
| 2018/0274870 | A1 * | 9/2018 | Law | F41A 3/82 |
| 2019/0170476 | A1 * | 6/2019 | Hiler, Jr. | F41A 21/482 |
| 2019/0204034 | A1 * | 7/2019 | Young | F41A 21/28 |
| 2019/0257601 | A1 * | 8/2019 | Brown | F41A 3/84 |
| 2019/0331450 | A1 * | 10/2019 | Steimke | F41A 3/26 |
| 2019/0383572 | A1 * | 12/2019 | Gregorich | F41A 15/14 |
| 2020/0025498 | A1 * | 1/2020 | Wheeler | F41A 21/325 |
| 2020/0109908 | A1 * | 4/2020 | Collazo | F41A 21/481 |
| 2020/0200505 | A1 * | 6/2020 | Brown, Jr. | F41C 27/00 |
| 2020/0240738 | A1 * | 7/2020 | Collazo | F41A 9/55 |

* cited by examiner

*Primary Examiner* — Benjamin P Lee

(57) ABSTRACT

An upper receiver assembly of a firearm is disclosed. The upper receiver assembly contains a barrel, an extension block removably coupled with the barrel, an upper receiver removably coupled with the extension block, a handguard mounting block removably coupled with the barrel, and a handguard removably coupled with the handguard mounting block.

3 Claims, 53 Drawing Sheets

FIREARM

CROSS REFERENCE TO RELATED APPLICATIONS

This application claims the benefit of U.S. Provisional Application No. 62/794,643, filed on Jan. 20, 2019, which is incorporated herein by reference in its entirety. This application is a continuation of U. S. patent application Ser. No. 16/746,909 titled "Firearm" filed Jan. 19, 2020, now issued U.S. Pat. No. 11,162,748, which is incorporated herein by reference in its entirety.

FIELD

The present invention relates to firearms. More particularly, the present invention relates to an upper receiver assembly of a firearm.

BACKGROUND

Referring to FIG. 1*a*, a lower assembly 1000 of a traditional AR15 firearm has a lower receiver 1500, a buffer 2000, a recoil spring 2500, an end plate 3000, a castle nut 3500, a buffer tube 4000, and a stock 4500. The buffer tube 4000 houses the buffer 2000 and the recoil spring 2500 therein, while the castle nut 3500 fastens the end plate 3000 and the buffer tube 4000 to the lower receiver 1500. The stock 4500 is typically attached to the buffer tube 4000 though its own latching mechanism (not shown), such that the stock 4500 can slide forward and backward as well as fasten to the buffer tube 4000 at various points on the buffer tube 4000, so that adjustment can be made to satisfy a specific length of arms of a user to allow the user to operate the firearm comfortably.

As known in the art, traditional AR15 firearms also contain a bolt carrier assembly 5000 located in an upper receiver (not shown) of the traditional AR15. When traditional AR15 firearm fires a cartridge, hot gas directed from a gas tube (not shown) of a firearm flows into the bolt carrier assembly 5000 causing the bolt carrier assembly 5000 to retract back toward the back of the firearm and compress the main spring 2500. A tail portion of the bolt carrier assembly 5000 would sink into or otherwise be received in the buffer tube 4000. As such, the traditional AR15 firearms require the buffer tube 35 to protrude (i.e. extend) from the lower receiver 1500 in order to safely and properly fire a cartridge.

Although there are some folding stock adaptor designs that allow for the buffer tube and stock of a firearm to be folded to one side of the firearm to shorten the weapon system for carrying by a user in various compact situations, the firearms with such folding stock adaptors cannot safely fire a cartridge when the buffer tube/stock is folded.

In view of the above, there exists a need for an improved firearm.

BRIEF DESCRIPTION OF THE FIGURES

FIGS. 3*a-b* depict a partially exploded view of a firearm according to some embodiments presently disclosed.

FIGS. 5*c-d* depict an assembled view of the upper receiver assembly in FIG. 5*a*.

FIGS. 7*c-f* depict an assembled view of the upper receiver assembly in FIG. 7*a*.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

As described herein, the term "pivotally connected" shall be used to describe a situation wherein two or more identified objects are joined together in a manner that allows one or both of the objects to pivot, and/or rotate about or in relation to the other object in either a horizontal or vertical manner.

As described herein, the term "removably coupled" and derivatives thereof shall be used to describe a situation wherein two or more objects are joined together in a non-permanent manner so as to allow the same objects to be repeatedly joined and separated.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 1A:
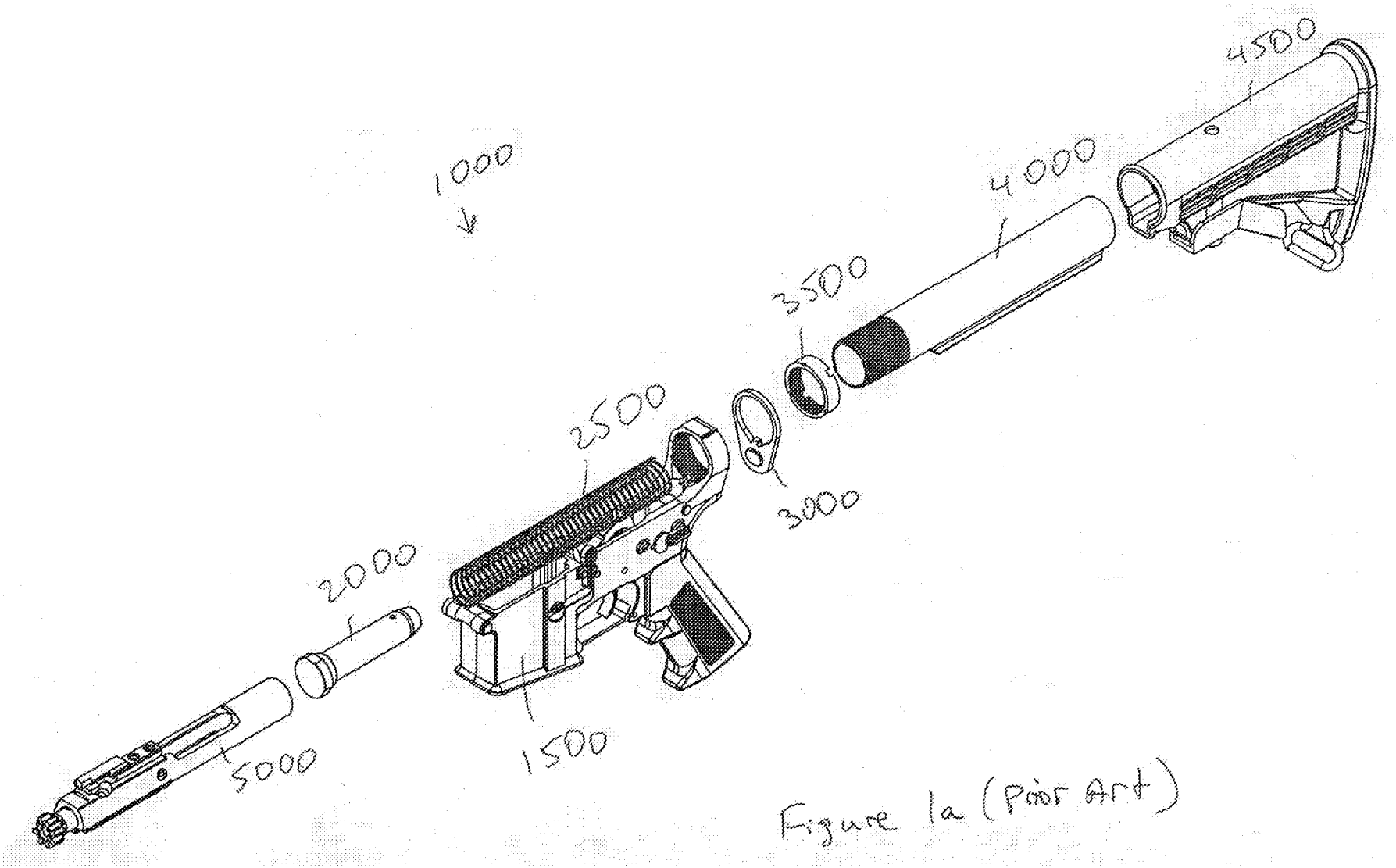
Figure 1a (Prior Art)
FIG. 1*a* depicts lower assembly of a traditional AR15 firearm known in the prior art.
Figure 1B:
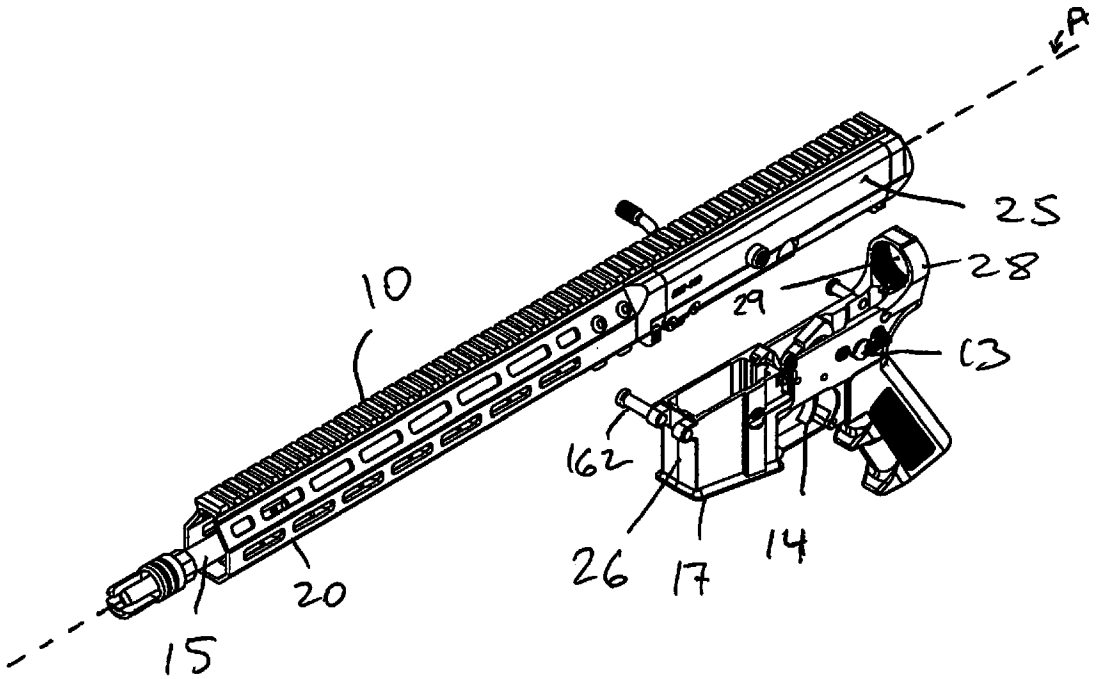
FIGS. 1*b-d* depict a partially exploded view of a firearm according to some embodiments presently disclosed.
Figure 1C:
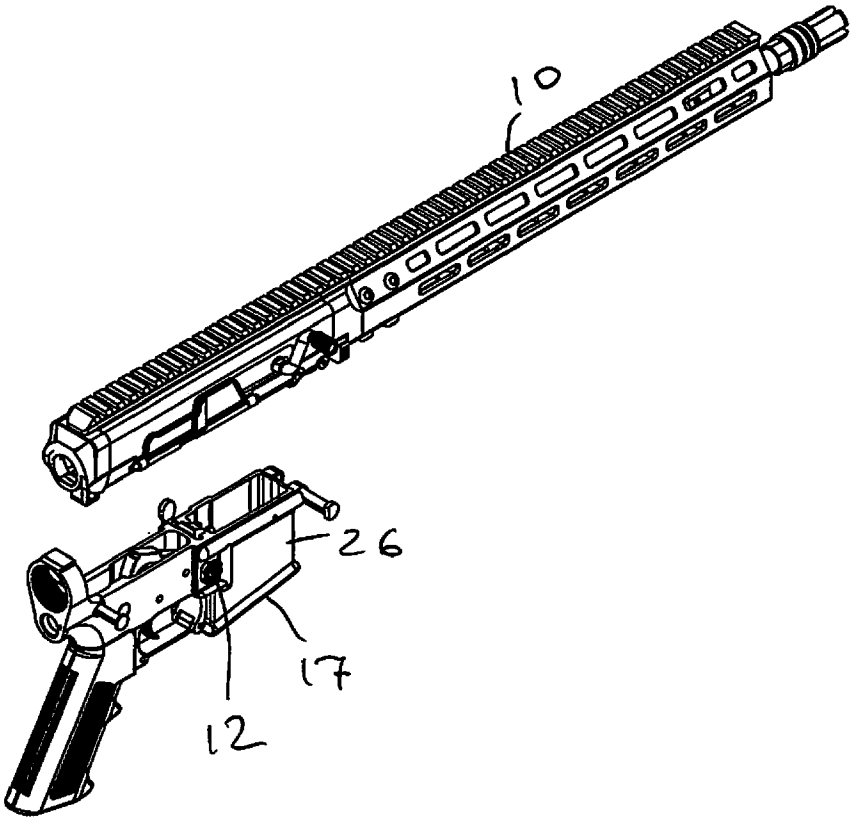
Figure 1D:
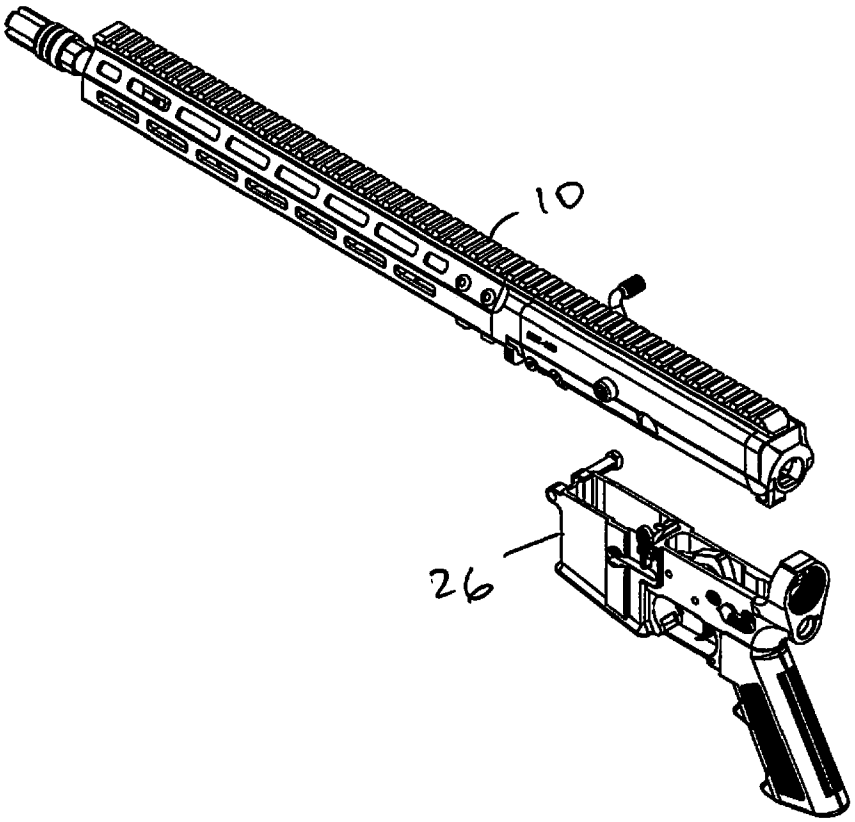
Figure 2A:
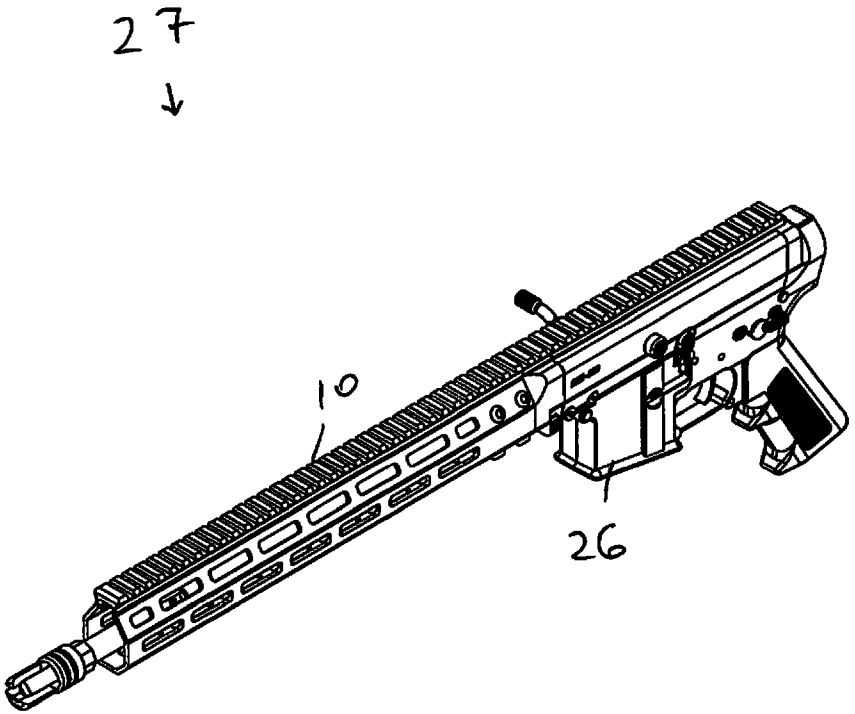
FIG. 2*a-d* depict an assembled view of the firearm in FIG. 1*b*.
Figure 2B:
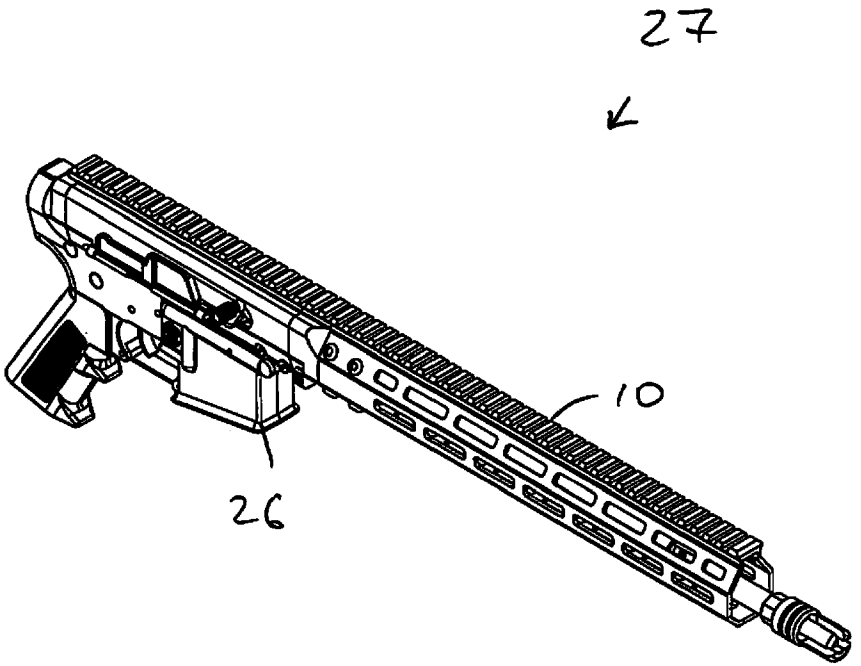
Figure 2C:
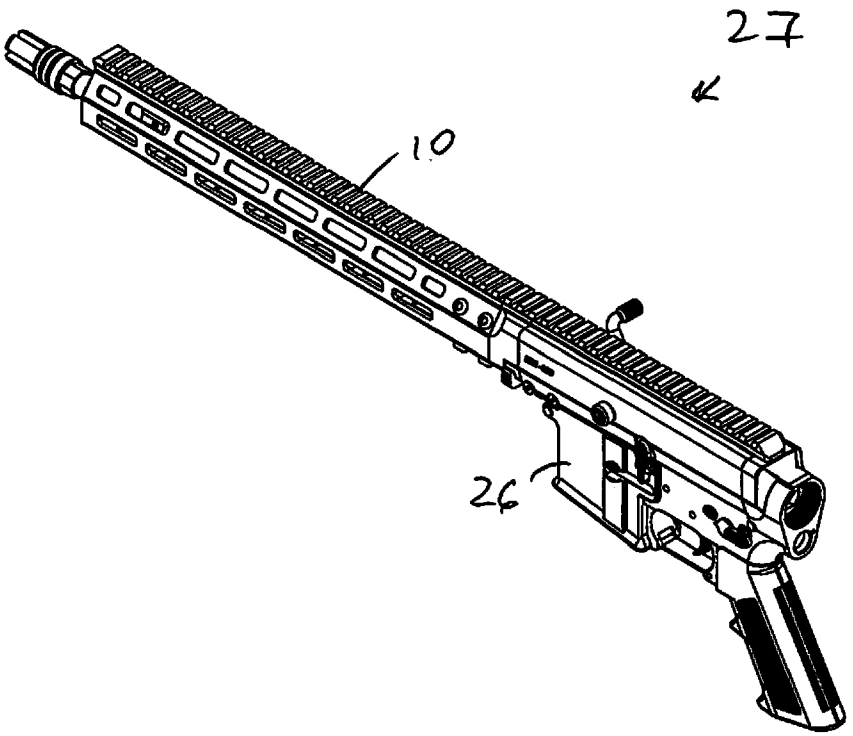
Figure 2D:
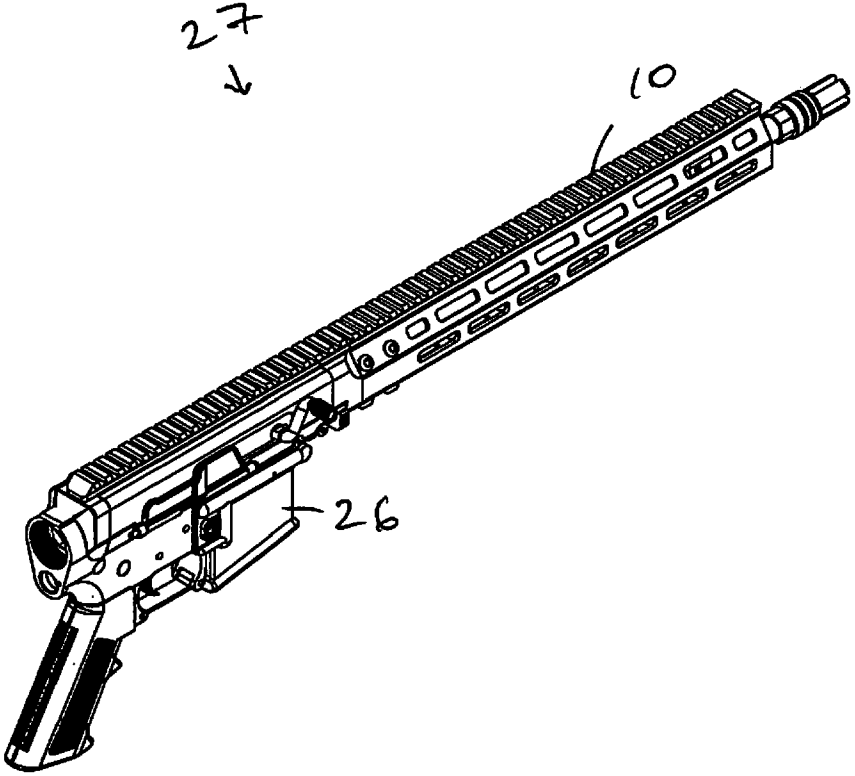
Figure 30:
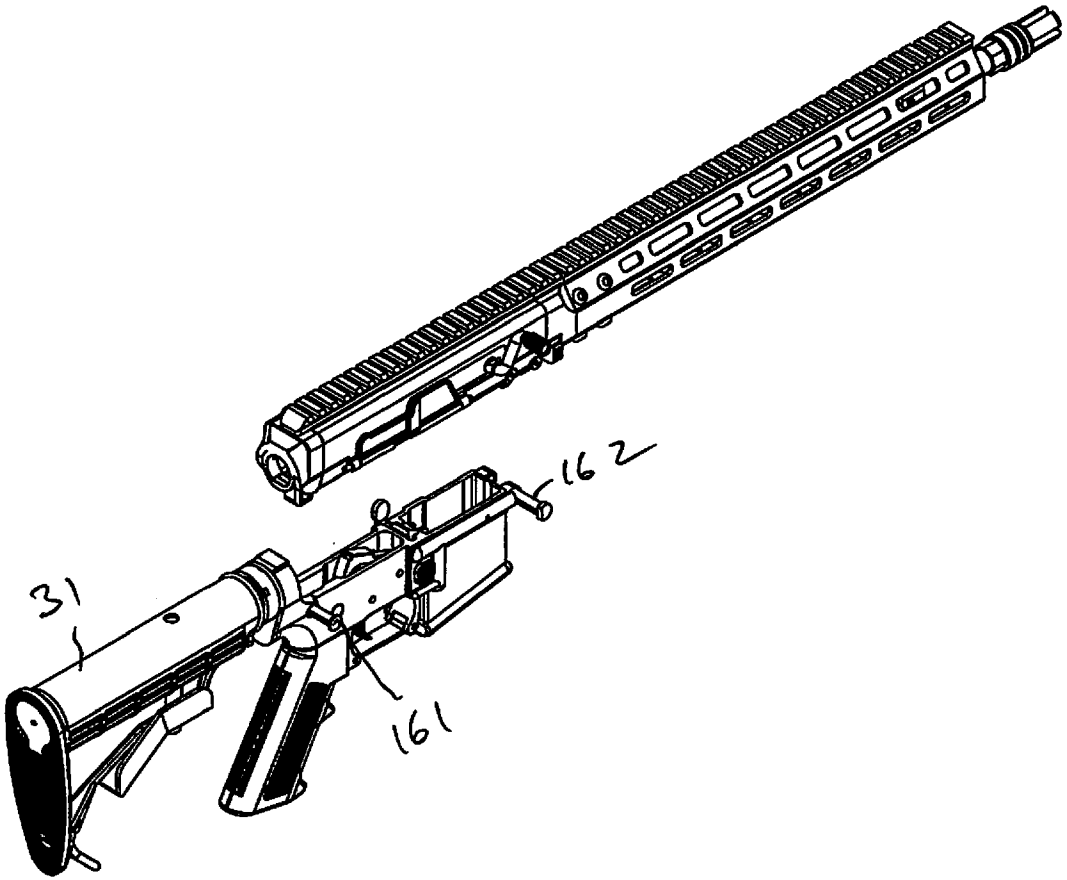

Referring to FIGS. 1*b-d*, an upper receiver assembly 10 is shown according to some embodiments presently disclosed. The upper receiver assembly 10 comprises a barrel 15, a handguard 20 and an upper receiver 25. According to some embodiments the upper receiver 25 is coupled to a lower receiver 26 shown in FIGS. 2*a-d* to form a firearm 27. The handguard 20 may removably encircle the barrel 15. According to some embodiments the upper receiver 25 is coupled with the barrel 15 as shown in FIG. 2*b*. According to some embodiments the upper receiver 25 is coupled with the hand guard 20. According to some embodiments the handguard 20 is coupled with the barrel 15 as shown in FIGS. 8*a-d*.

According to some embodiments, the lower receiver 26 comprises a trigger 14 and a fire control selector or switch 13. The fire control selector 13 enables the user to switch between modes of fire, such as for example, SAFE and SEMI-AUTOMATIC (i.e. FIRE). Other modes, such as burst (not shown) and/or automatic (not shown), may also be provided. The user rotates the fire control selector 13 with a thumb or other finger(s) to switch between firearm modes of operation.

According to some embodiments, the lower receiver 26 comprises a magazine release assembly 12 for a quick release of a magazine from a magazine well 17 of the lower receiver 26.

Figure 3B:
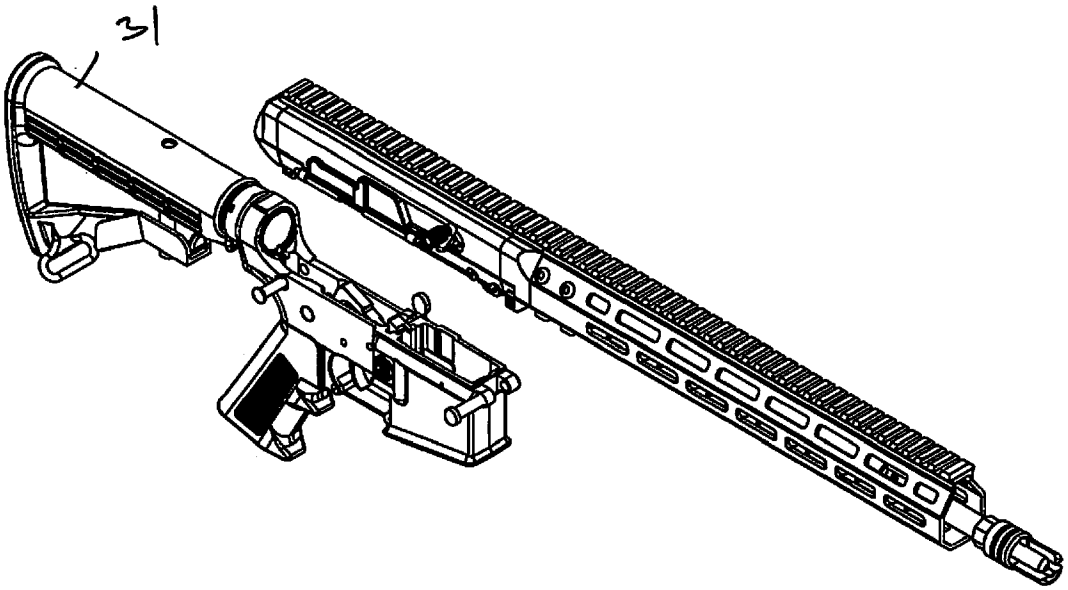

According to some embodiments, the lower receiver 26 comprises an upwardly extending lobe 28. According to some embodiments, the upwardly extending lobe 28 is integral with the lower receiver 26. According to some embodiments, the upwardly extending lobe 28 may be used to mount a buttstock 31 (shown in FIGS. 3*a-b*) to the lower receiver 26. According to some embodiments, the upwardly extending lobe 28 comprises a generally circular threaded through-hole 29 adapted to receive the mating male threads on the buttstock 31. According to some embodiments presently disclosed, the buttstock 31 does not contain a recoil spring and does not contain a buffer.

According to some embodiments, the upwardly extending lobe 28 may be used to mount a receiver extension (not shown) to the lower receiver 26. According to some embodiments, the receiver extension is a buffer tube. According to some embodiments, the upwardly extending lobe 28 comprises a generally circular threaded through-hole 29 adapted to receive the mating male threads on the receiver extension. According to some embodiments, the stock 31 is attached to the receiver extension (not shown) such that the stock 31 can slide forward and backward as well as fasten to the receiver extension at various points on the receiver extension, so that adjustment can be made to satisfy a specific length of arms of a user to allow the user to operate the firearm comfortably.

According to some embodiments presently disclosed, the receiver extension (not shown) is solid piece of material. According to some embodiments presently disclosed, the receiver extension (not shown) is hollow. According to some embodiments presently disclosed, the receiver extension (not shown) does not contain a recoil spring and does not contain a buffer.

Upon discharge of a round, a bolt carrier assembly 115 (described below in more detail) within the upper receiver 25 is driven rearward by action of the gas discharged by the firing action. According to some embodiments presently disclosed, no portion of the bolt carrier assembly 115 (described below in more detail) enters the through-hole 29 when the firearm 27 discharges a round.

Figure 4:
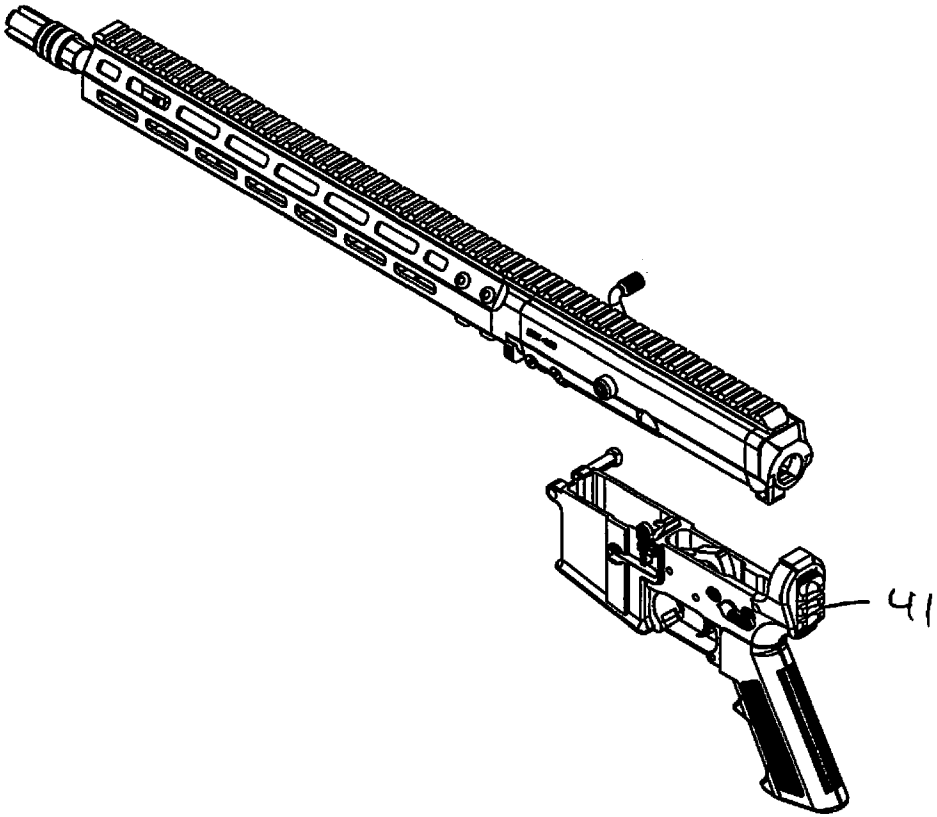
FIG. 4 depicts a partially exploded view of a firearm according to some embodiments presently disclosed.
Figure 5A:
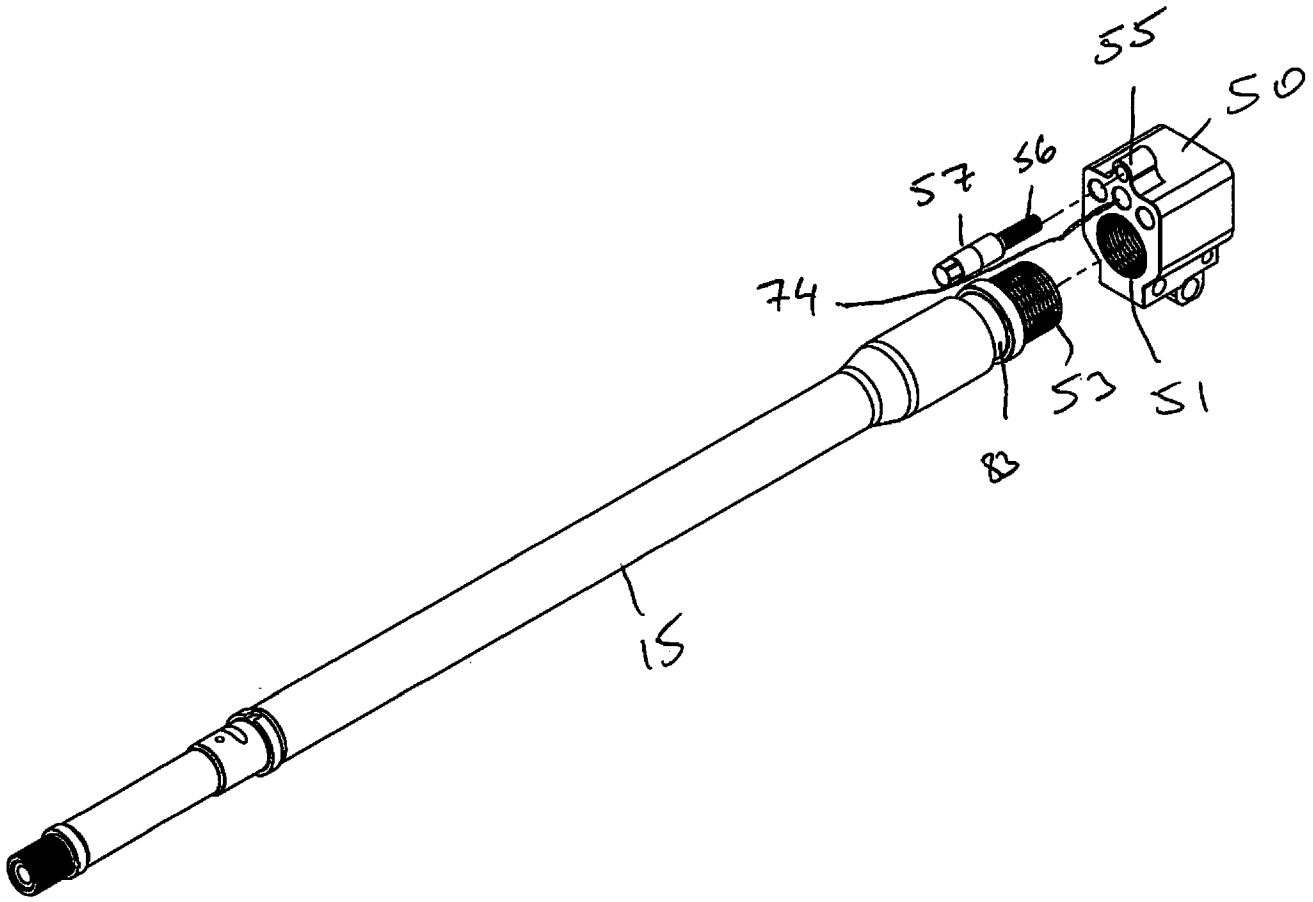
FIGS. 5*a-b* depict an exploded view of an upper receiver assembly according to some embodiments presently disclosed.
Figure 5B:
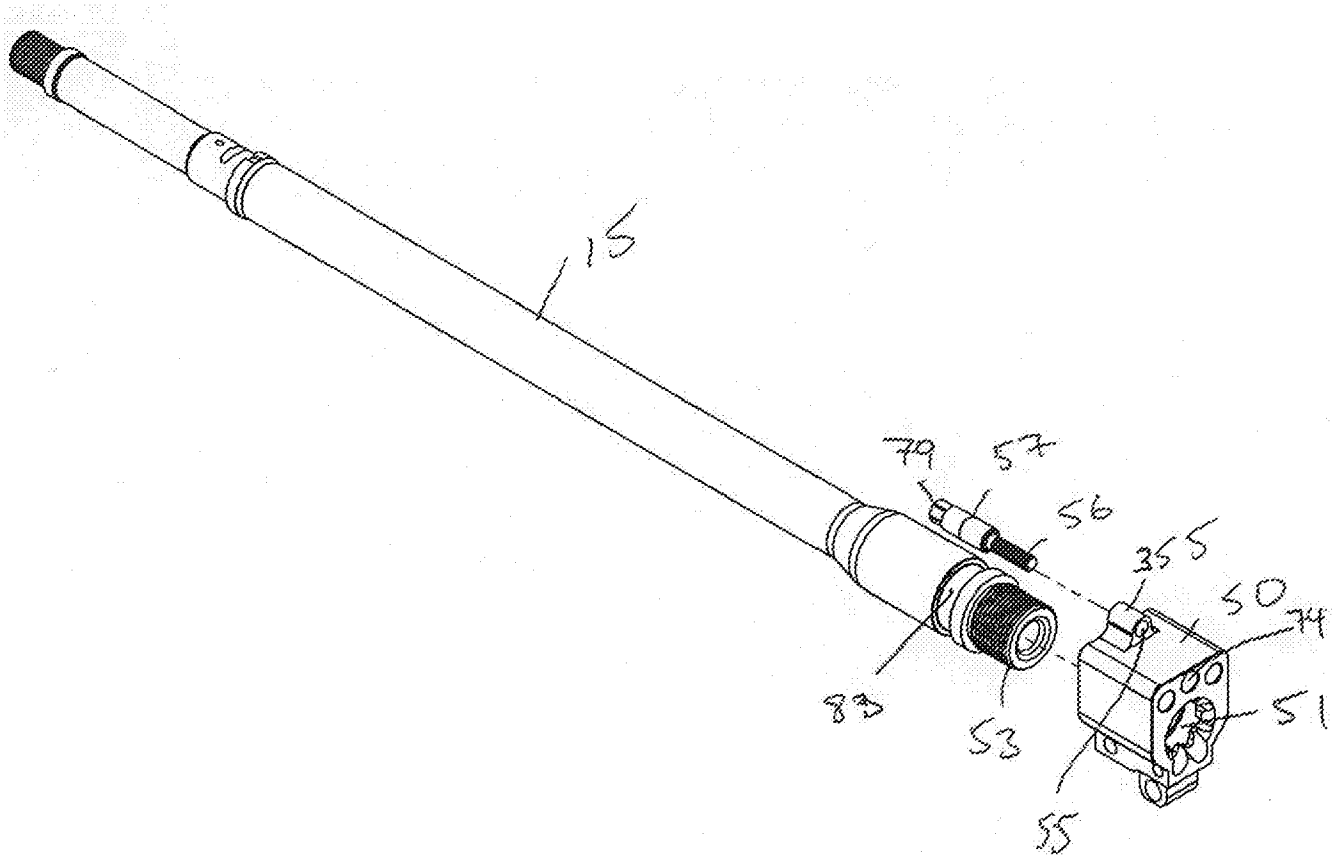
Figure 5C:
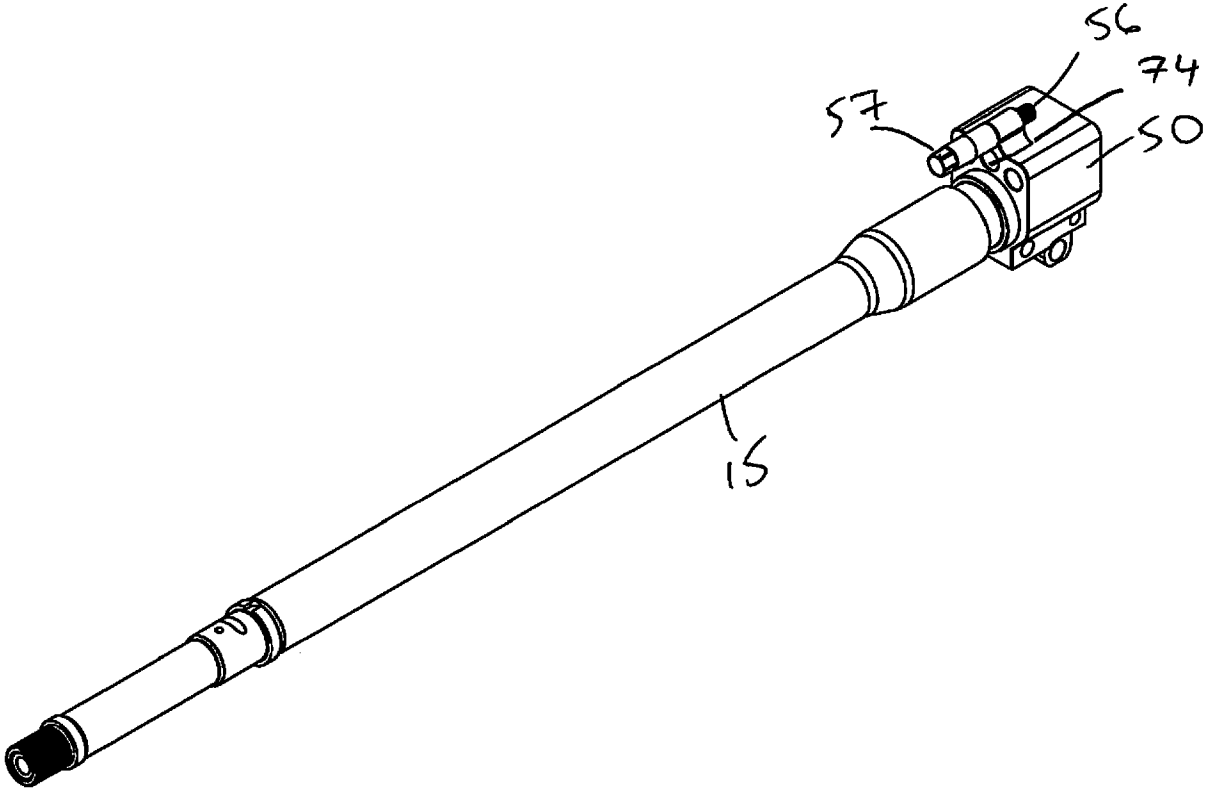
Figure 58:
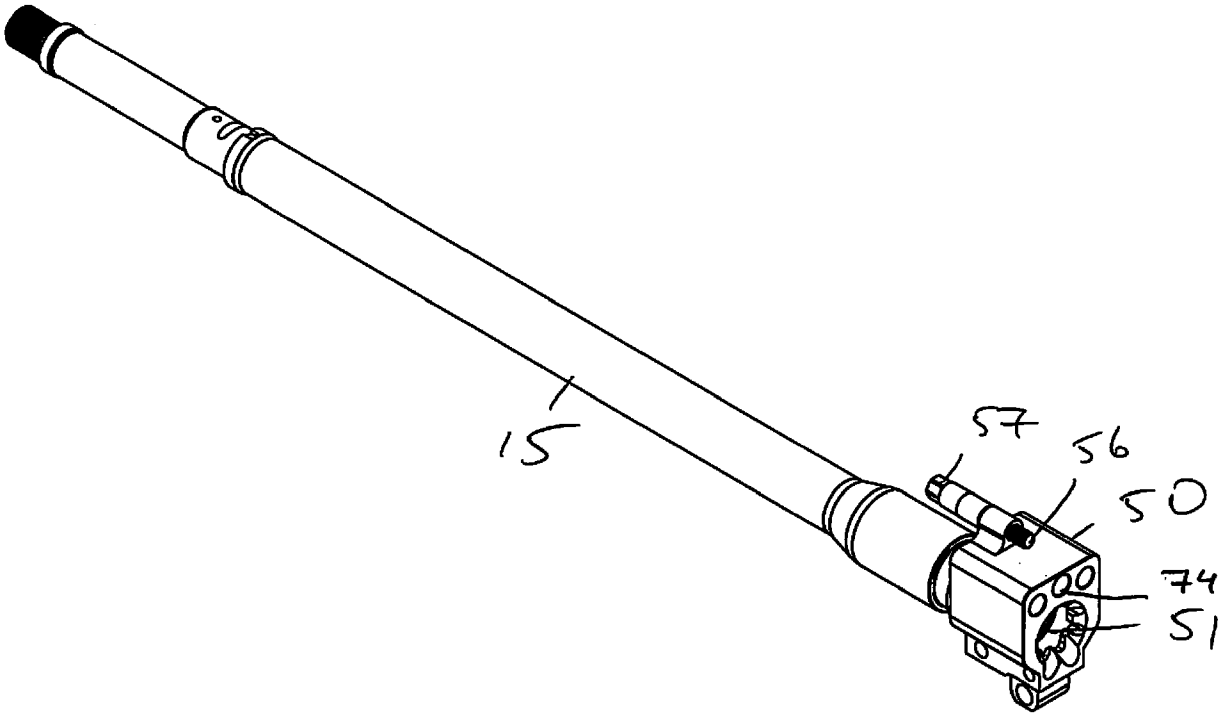

According to some embodiments, the upwardly extending lobe 28 is adapted to receive a feature 41 shown in FIG. 4. According to some embodiments, the feature 41 is a folding stock adaptor for coupling a foldable buttstock (shown shown) to the lower receiver 26. According to some embodiments, the firearm 27 is configured to fire one or more rounds while the foldable stock is folded to one side of the firearm 27.

According to some embodiments, the feature 41 is a cap to cover the through-hole 29 and/or to prevent dust/dirt from entering the upper receiver 25. According to some embodiments, the through-hole 29 remains open (i.e. not covered) during the firing of the firearm 27 shown in FIGS. 2*c-d*.

According to some embodiments, the upper receiver assembly 10 comprises the barrel 15 removably coupled with an extension block 50 as shown in FIGS. 5*a-d*. According to some embodiments, the extension block 50 comprises a through aperture (i.e. through opening) 51 configured to accommodate a first end 53 of the barrel 15. According to some embodiments, the extension block 50 comprises a generally circular threaded through aperture (i.e. through opening) 51 adapted to receive the mating male threads on the first end 53 of the barrel 15.

According to some embodiments, the extension block 50 comprises an aperture 55 configured to accommodate a handguard mounting fastener 57 as shown in FIGS. 5*a-d*. According to some embodiments, the extension block 50 comprises an aperture (i.e. an opening) 55 configured to accommodate a first end 56 of the handguard mounting fastener 57. According to some embodiments, the extension block 50 comprises a generally circular threaded aperture 55 adapted to receive the mating male threads on the first end 56 of the handguard mounting fastener 57. According to some embodiments, the aperture 55 is a through-aperture (i.e. through opening). According to some embodiments, the aperture 55 is formed in a protrusion 355 of the extension block 50.

Figure 12A:
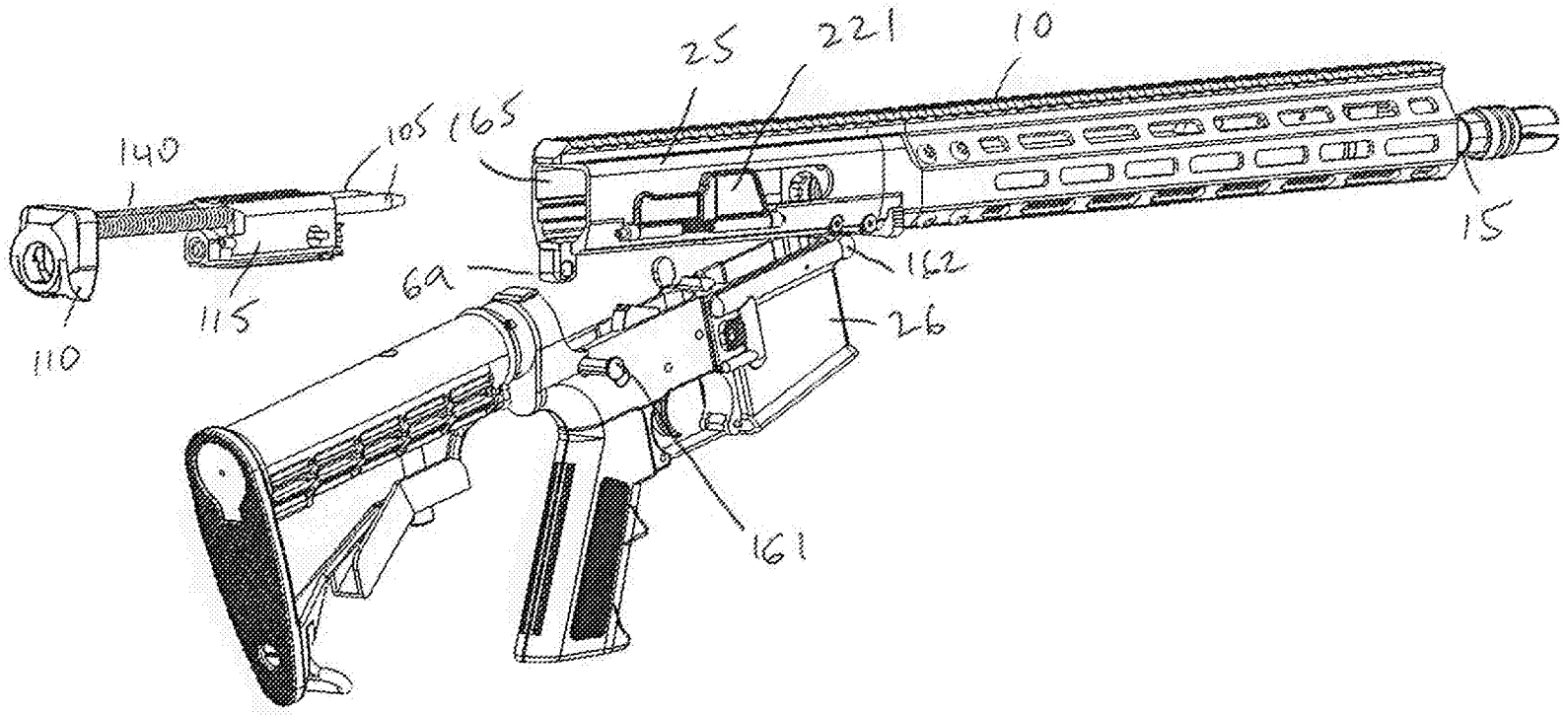
FIGS. 12*a-b* depict another embodiment presently disclosed.
Figure 12B:
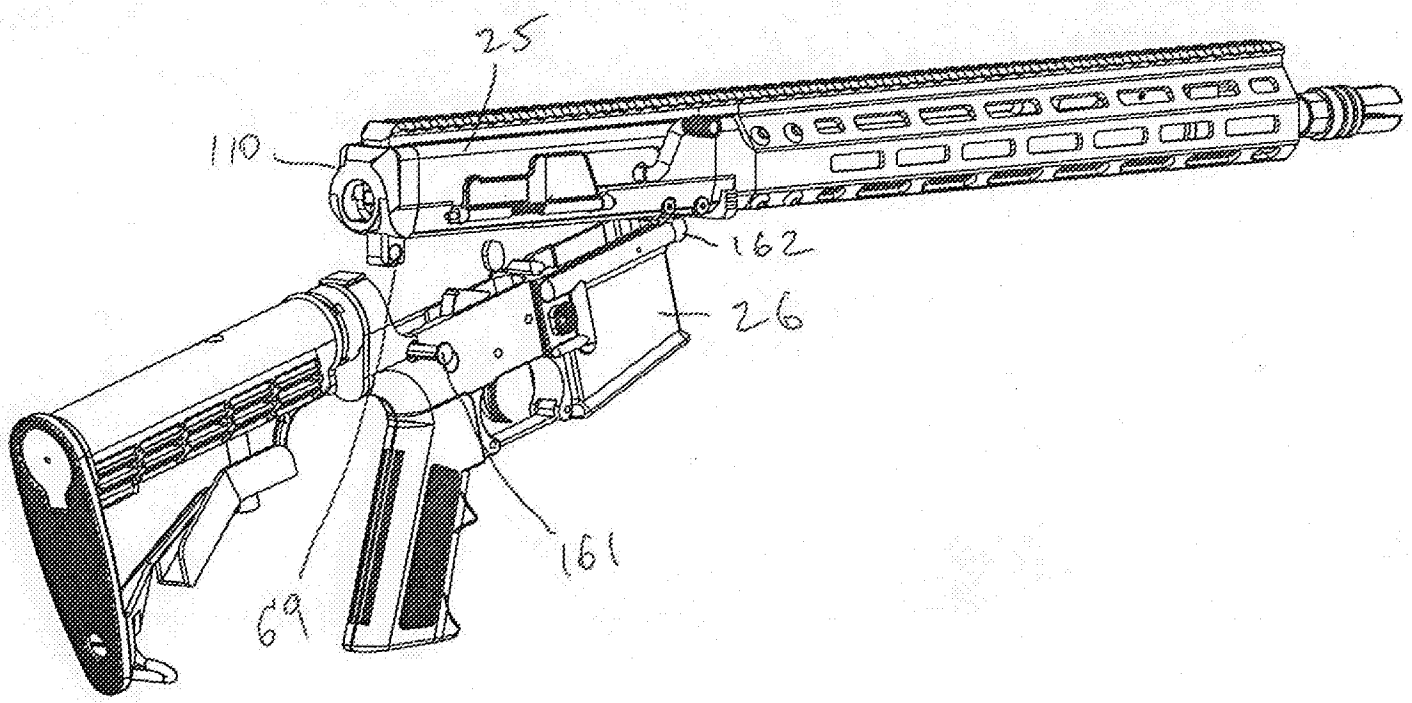

According to some embodiments, the extension block 50 comprises an aperture 59 configured to accommodate a fastener 162 (shown in FIGS. 12*a-b*) to be pivotally coupled with the lower receiver 26 as shown in FIGS. 12*a-b*. According to some embodiments, the aperture 59 is a through-aperture (i.e. through opening).

According to some embodiments, the upper receiver assembly 10 comprises the upper receiver 25 coupled with the extension block 50 using, for example, one or more fasteners 61 as shown in FIGS. 6*a-d*. According to some embodiments, the one or more fasteners 61 are shoulder bolts.

Figure 6A:
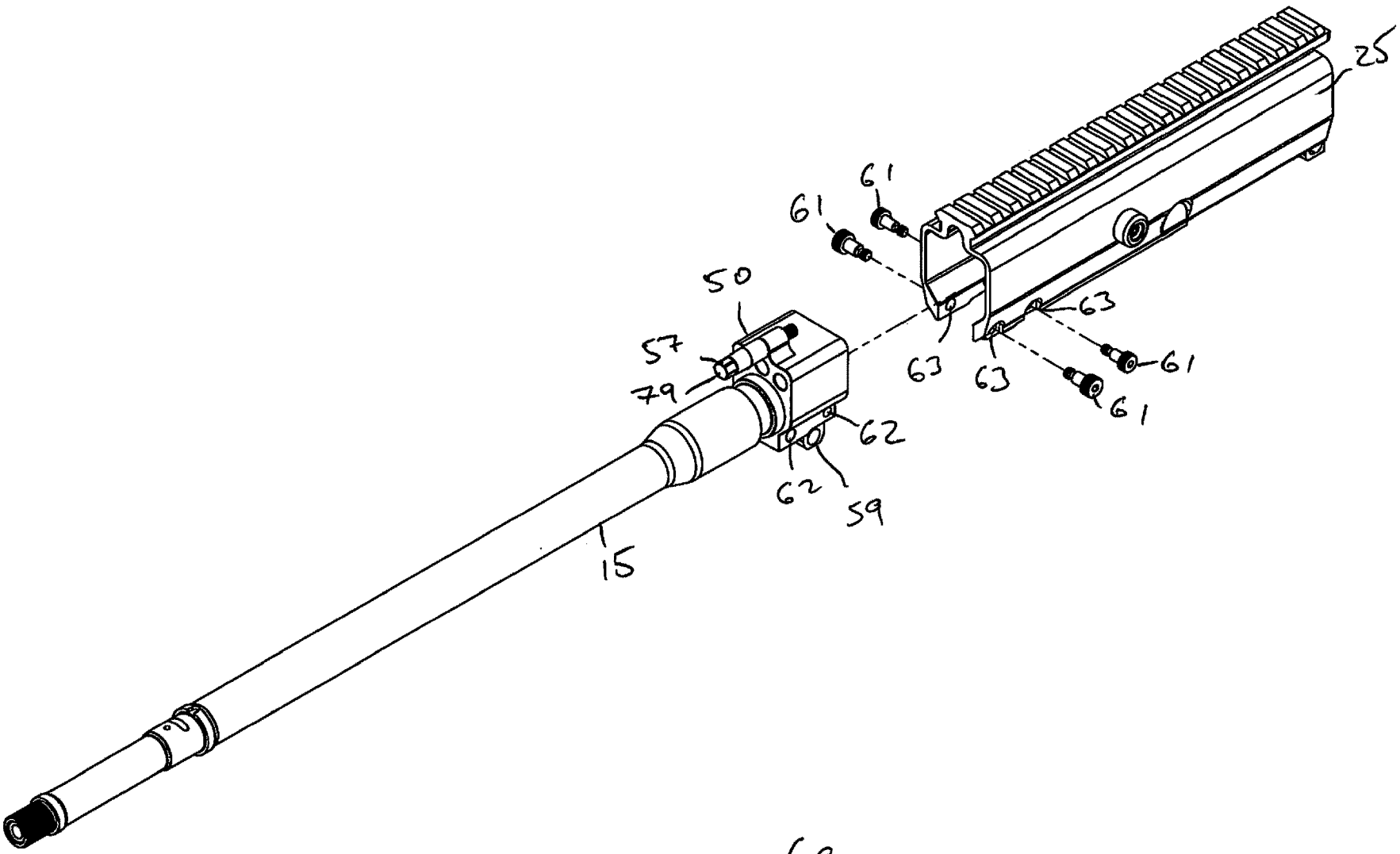
FIGS. 6*a-b* depict another exploded view of an upper receiver assembly according to some embodiments presently disclosed.
Figure 6B:
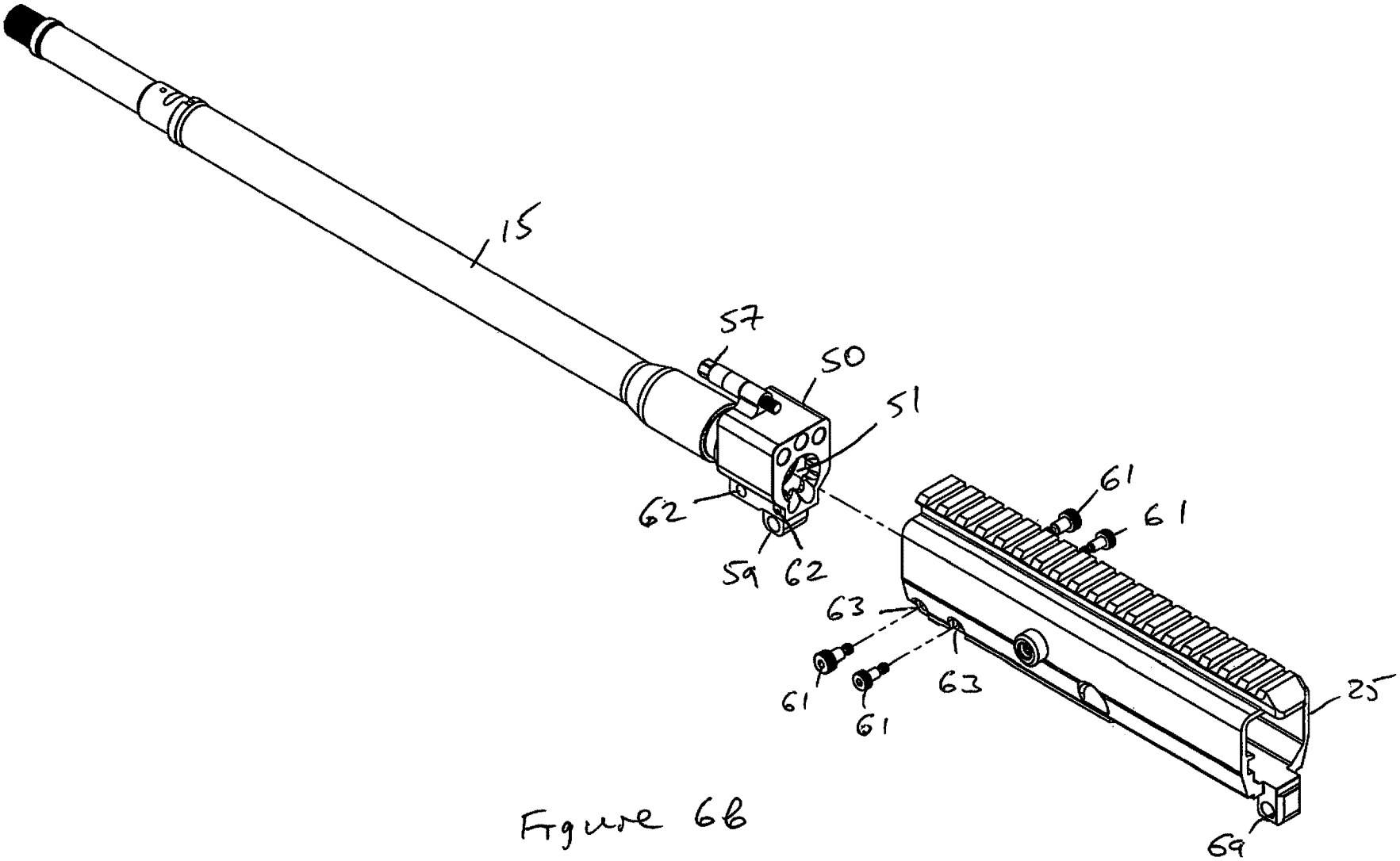
Figure 6C:
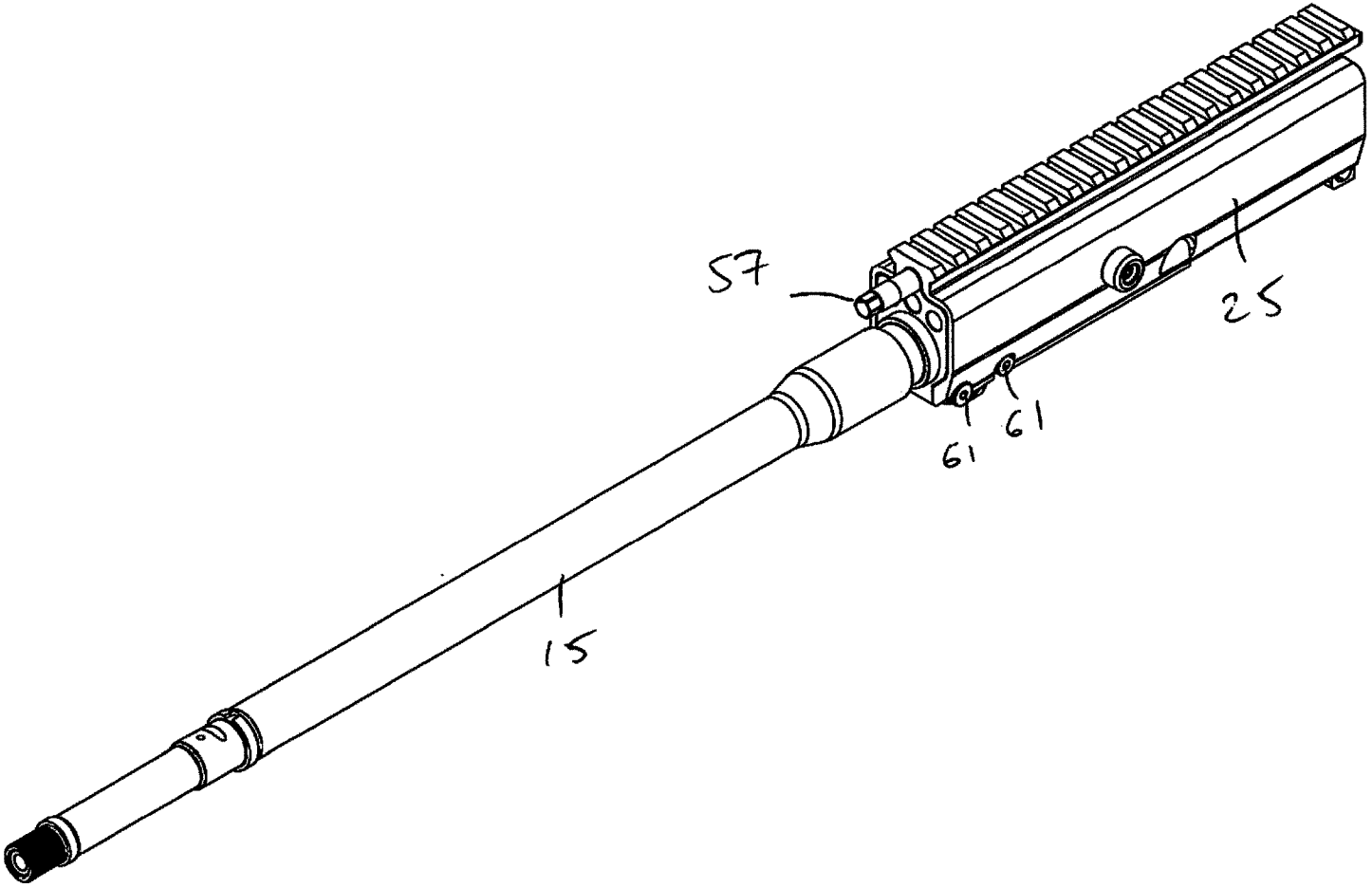
FIGS. 6*c-d* depict an assembled view of the upper receiver assembly in FIG. 6*a*.
Figure 6D:
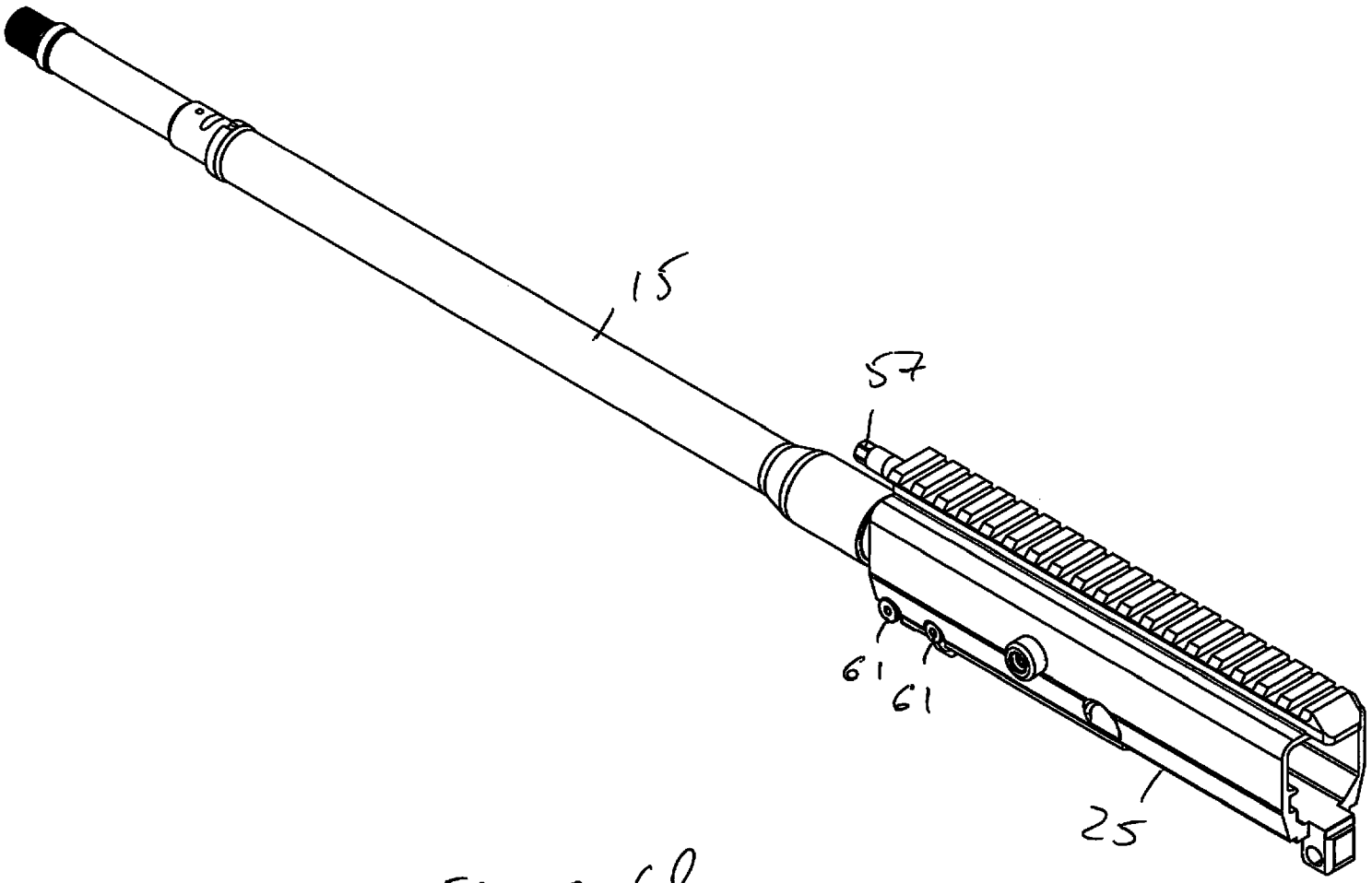

According to some embodiments, the extension block 50 comprises one or more apertures 62 and the upper receiver 25 comprise one or more apertures 63 configured to accommodate the one or more fasteners 61. According to some embodiments, the extension block 50 is completely enclosed by the upper receiver 25 as shown in FIGS. 6*c-d*. According to some embodiments, the extension block 50 is substantially enclosed by the upper receiver 25 as shown in FIGS. 6*c-d*. According to some embodiments, the extension block 50 is covered by the upper receiver 25 as shown in FIGS. 6*c-d*. According to some embodiments, the extension block 50 is surrounded by the upper receiver 25 as shown in FIGS. 6*c-d*.

According to some embodiments, the extension block 50 comprises an aperture 69 configured to accommodate a fastener 161 (shown in FIGS. 12*a-b*) to be coupled with the lower receiver 26. According to some embodiments, the aperture 69 is a through-aperture (i.e. through opening).

According to some embodiments, the upper receiver assembly 10 comprises a gas block 71 coupled with the barrel 15 and a piston assembly 72 coupled with the gas block 71. According to some embodiments, the piston assembly 72 comprises a piston rod 73 extending through an aperture 74 of the extension block 50. According to some embodiments, the piston rod 73 extends through the aperture 74 of the extension block 50 and abuts a bolt carrier assembly 115 (discussed in more detail below).

According to some embodiments, the upper receiver assembly 10 comprises a handguard mounting block 75 coupled with the barrel 15 using a slide lock plate 76 as shown in FIGS. 7*a-d*. According to some embodiments, the handguard mounting block 75 comprises an aperture 77 configured to accommodate the gas block 71 and the barrel 15. According to some embodiments, the handguard mounting block 75 comprises an aperture 78 configured to accommodate a second end 79 of the handguard mounting fastener 57. According to some embodiments, the apertures 77 and/or 78 are through-apertures (i.e. through openings). According to some embodiments, the apertures 78 is formed within the aperture 77. According to some embodiments, the apertures 78 is formed as part of the aperture 77. According to some embodiments, the apertures 78 is part of the aperture 77.

Figure 7A:
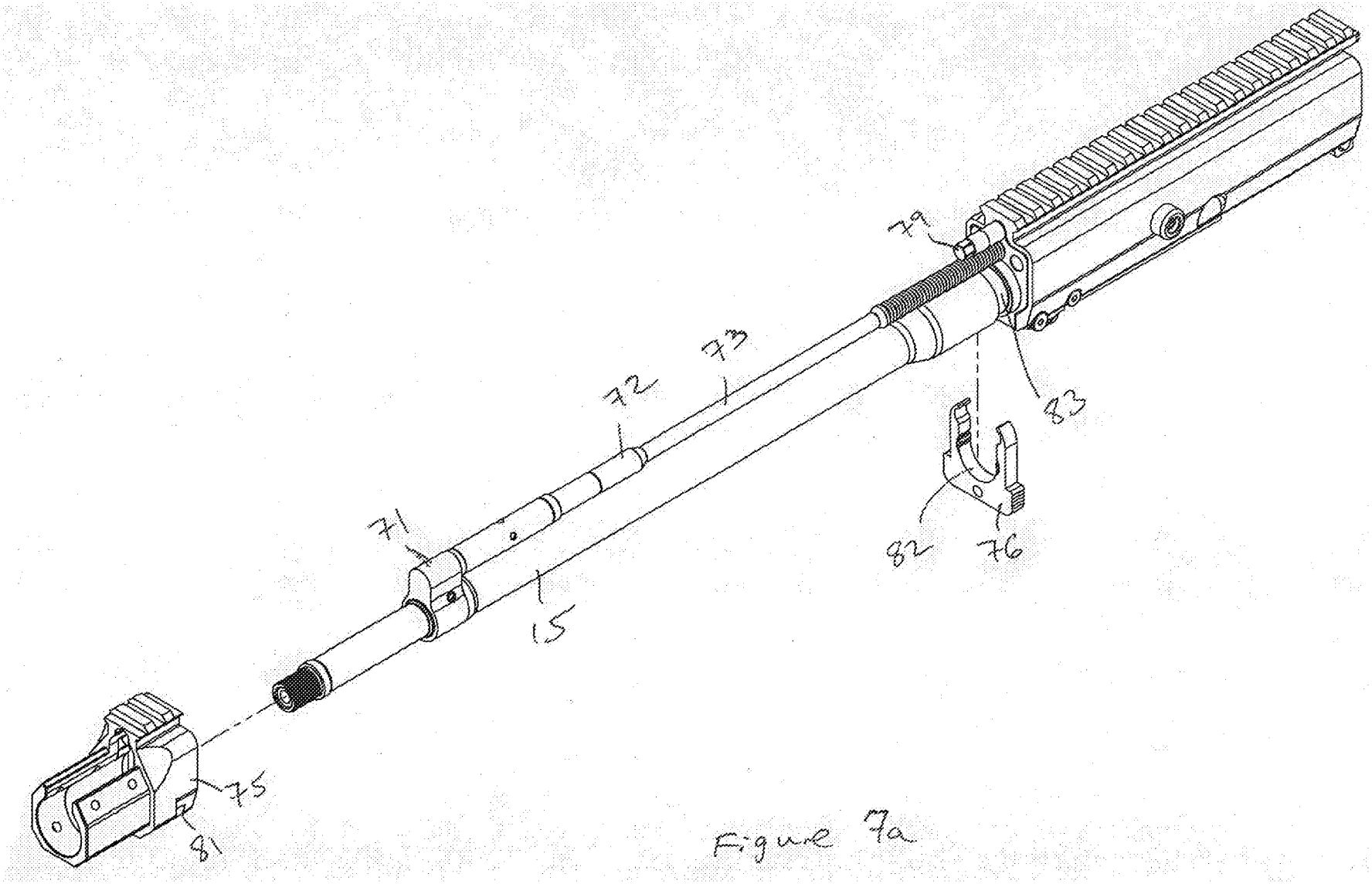
FIGS. 7*a-b* depict another exploded view of an upper receiver assembly according to some embodiments presently disclosed.
Figure 7B:
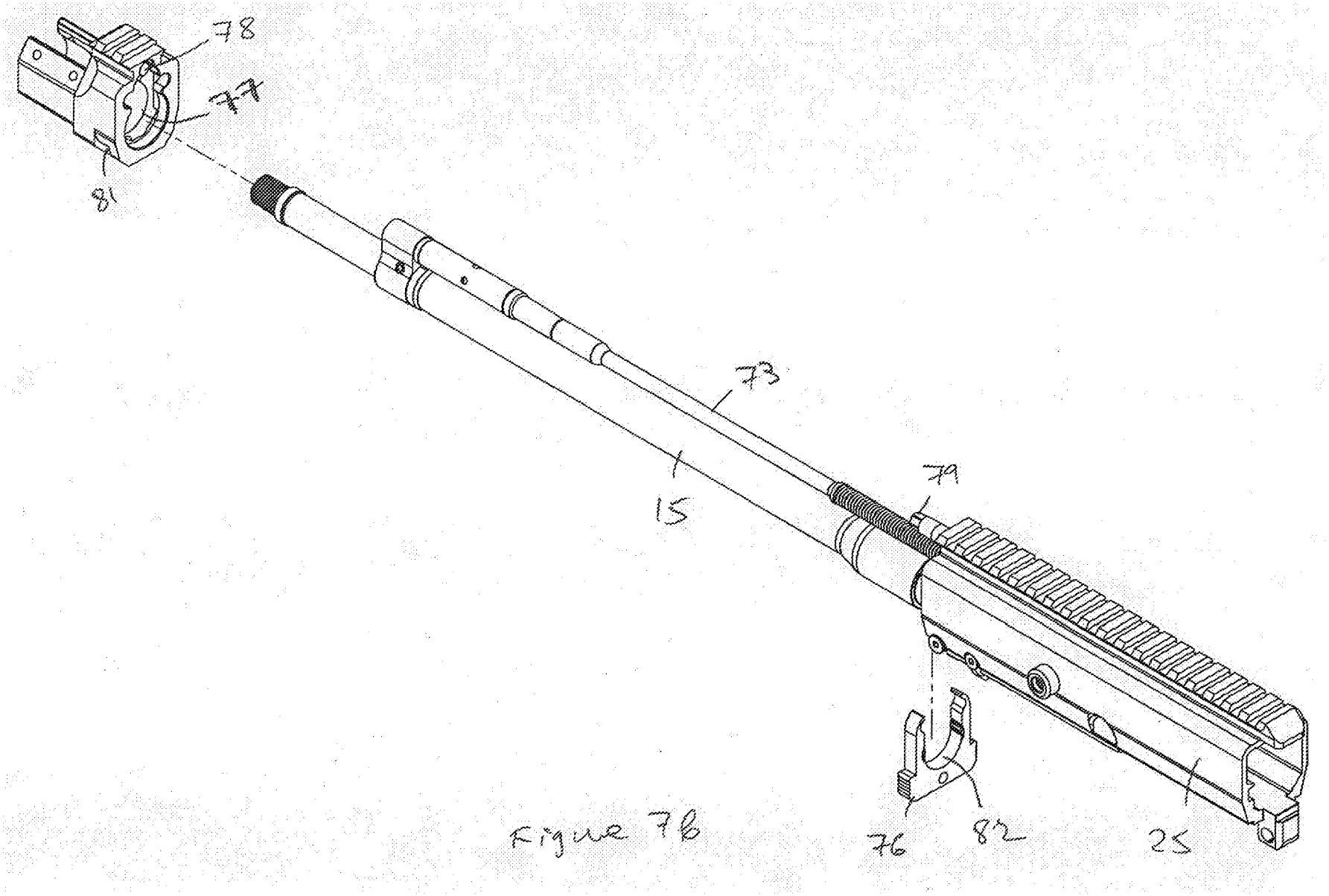
Figure 7C:
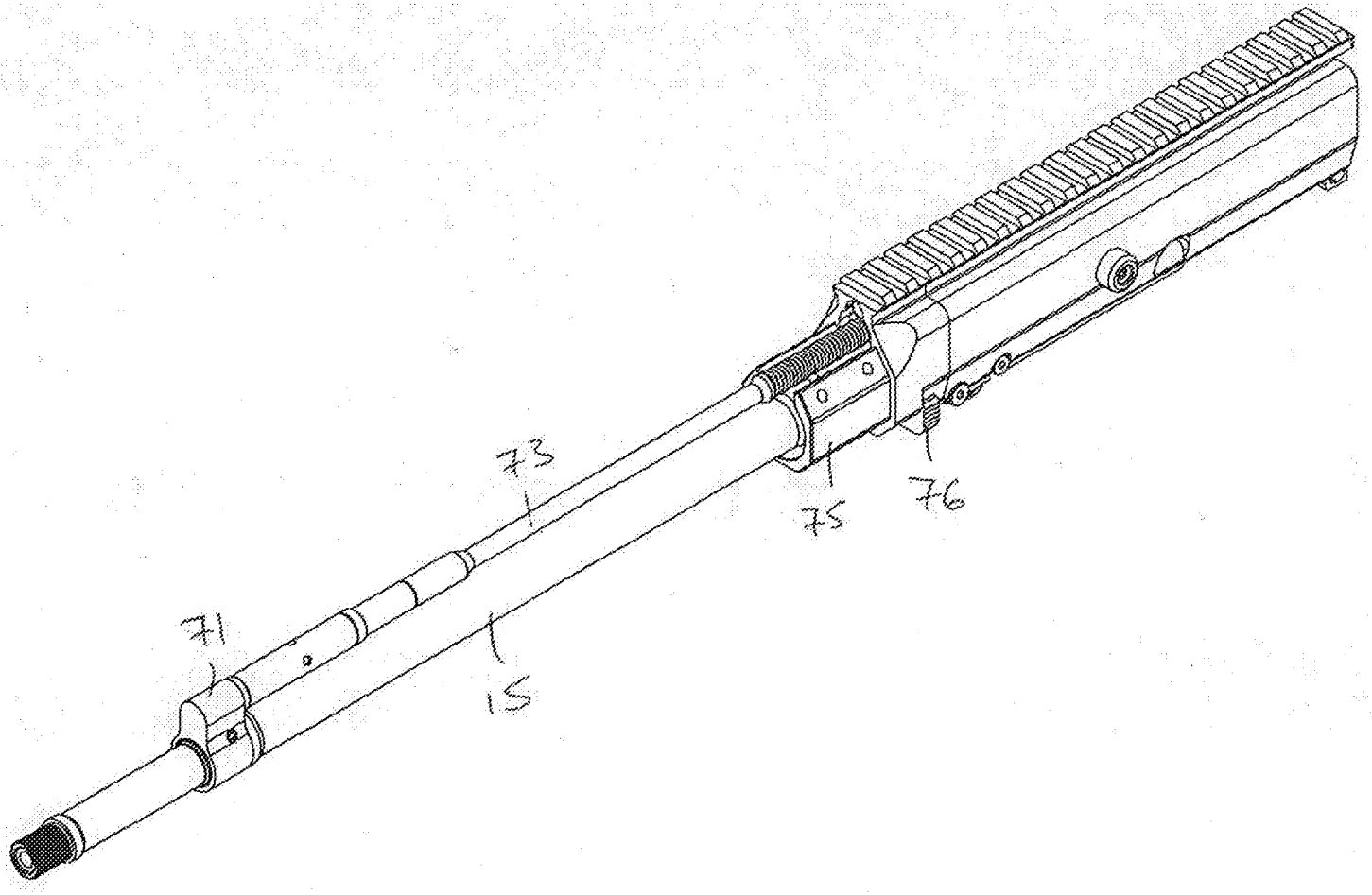
Figure 7D:
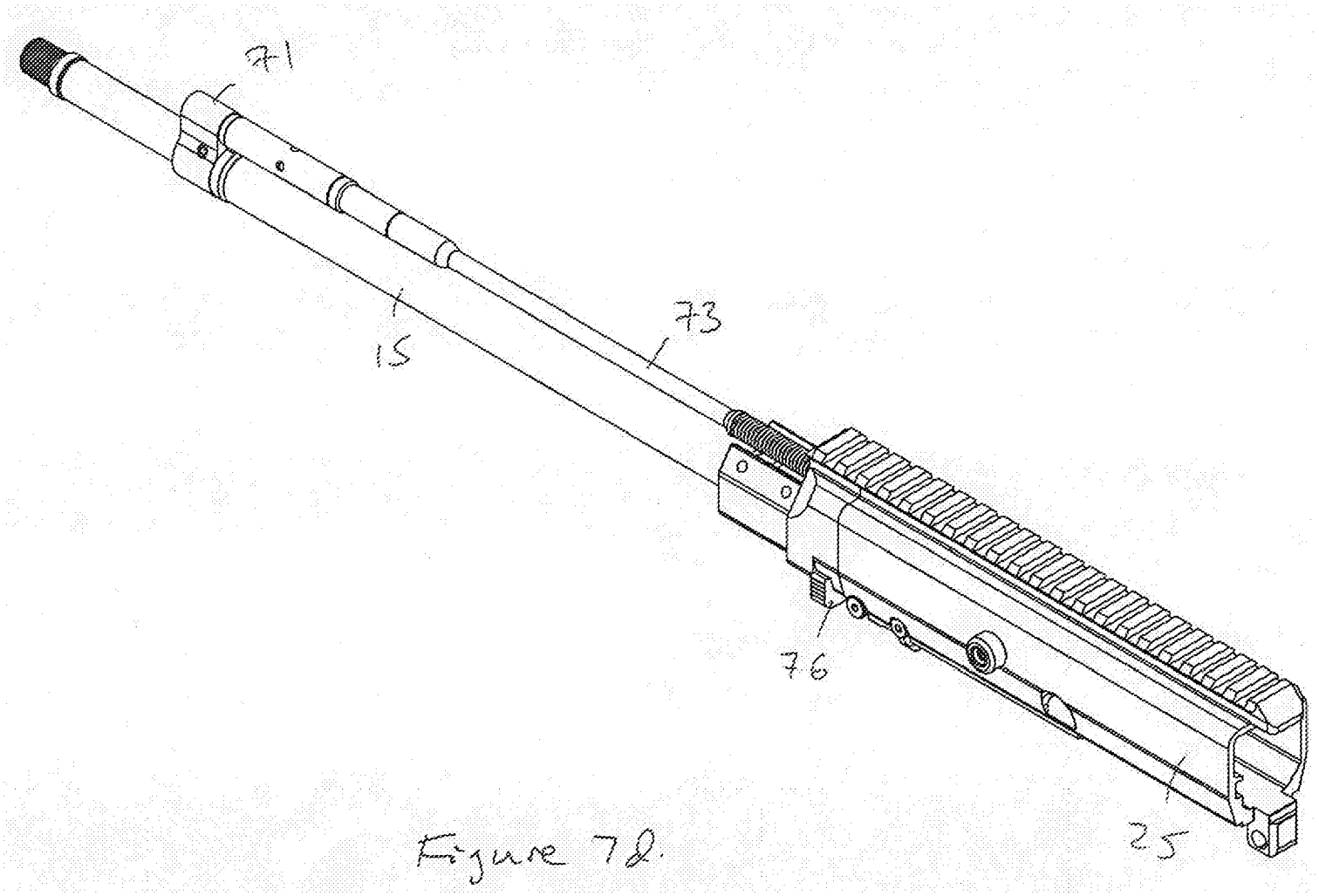
Figure 7E:
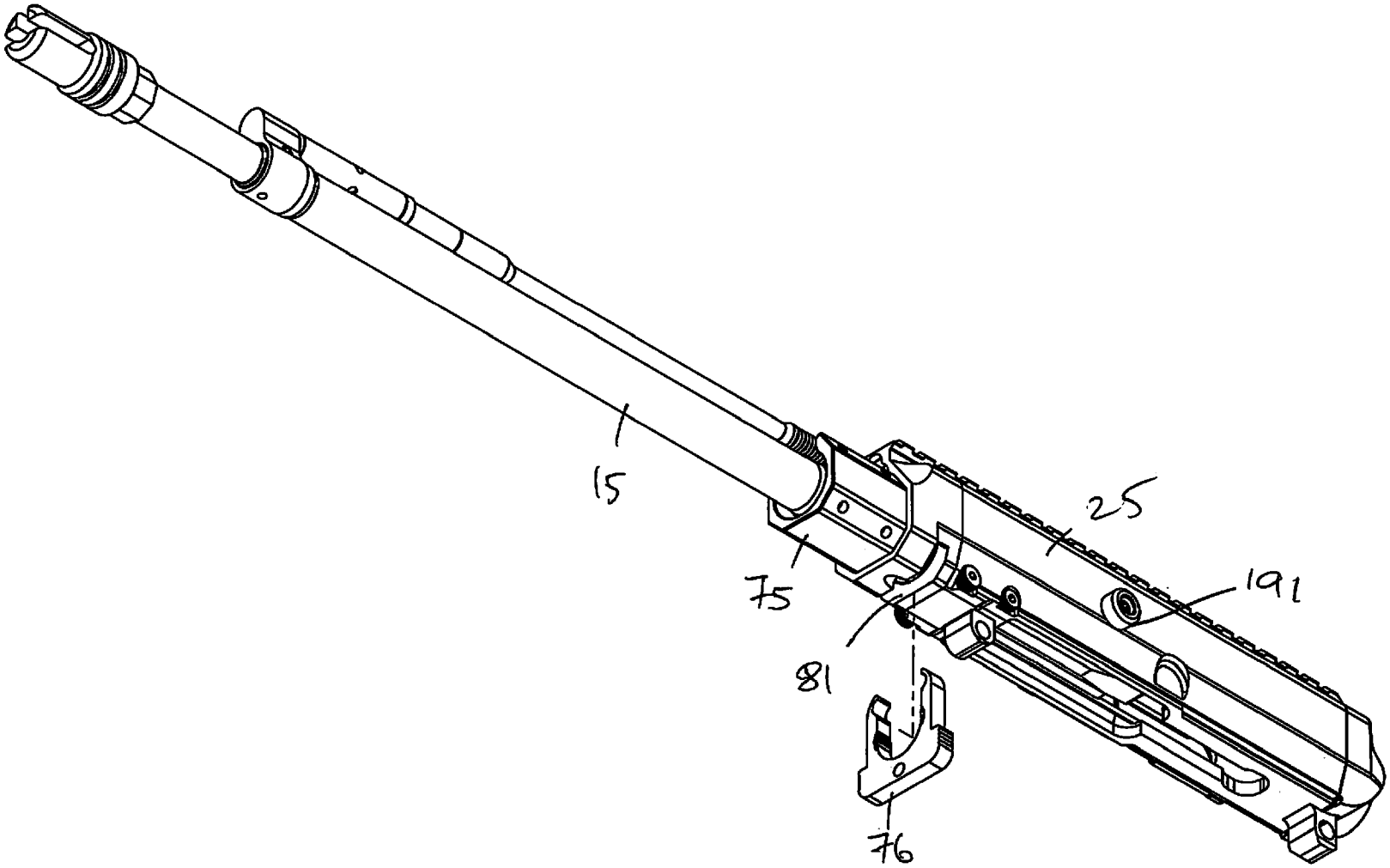
Figure 78:
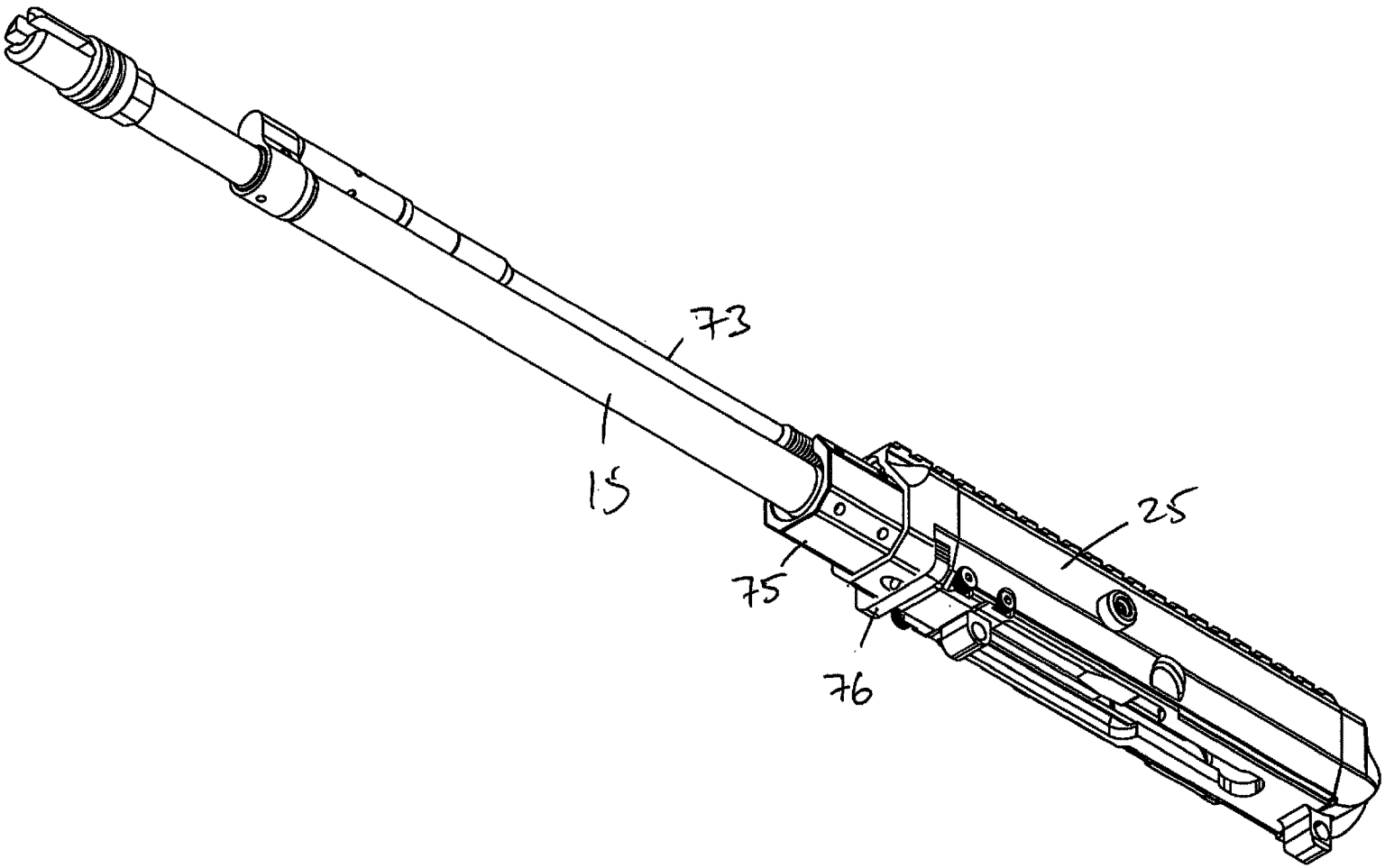

According to some embodiments, the handguard mounting block 75 comprises an aperture 81 configured to accommodate the slide lock plate 76 as shown in FIGS. 7*e-f*. According to some embodiments, the slide lock plate 76 is U-shaped. According to some embodiments, the slide lock plate 76 comprises an inner surface 82 configured to abut the barrel 15 and prevent the handguard mounting block 75 from being removed from the barrel 15. According to some embodiments, the barrel 15 comprises a channel 83 configured to accommodate at least a portion of the slide lock plate 76. According to some embodiments, the barrel 15 comprises a channel 83 configured to accommodate the inner surface 82 of the slide lock plate 76 and prevent the handguard mounting block 75 from being removed from the barrel 15.

According to some embodiments, the upper receiver assembly 10 comprises the handguard 20 removably coupled with the handguard mounting block 75 using one or more fasteners 83 as shown in FIGS. 8*a-d*. According to some embodiments, the one or more fasteners 83 are mounting screws.

Figure 8A:
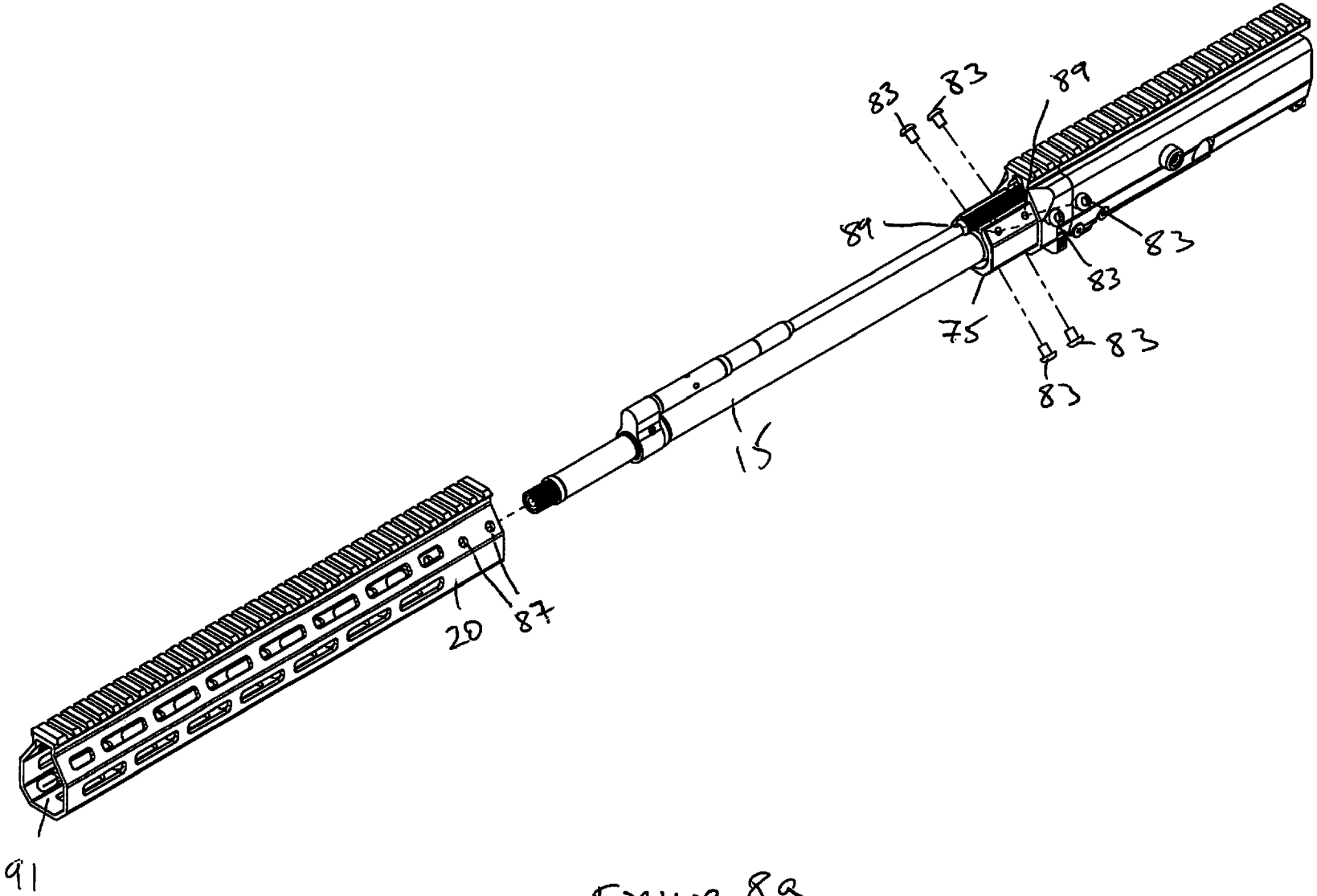
FIGS. 8*a-b* depict another exploded view of an upper receiver assembly according to some embodiments presently disclosed.
Figure 8B:
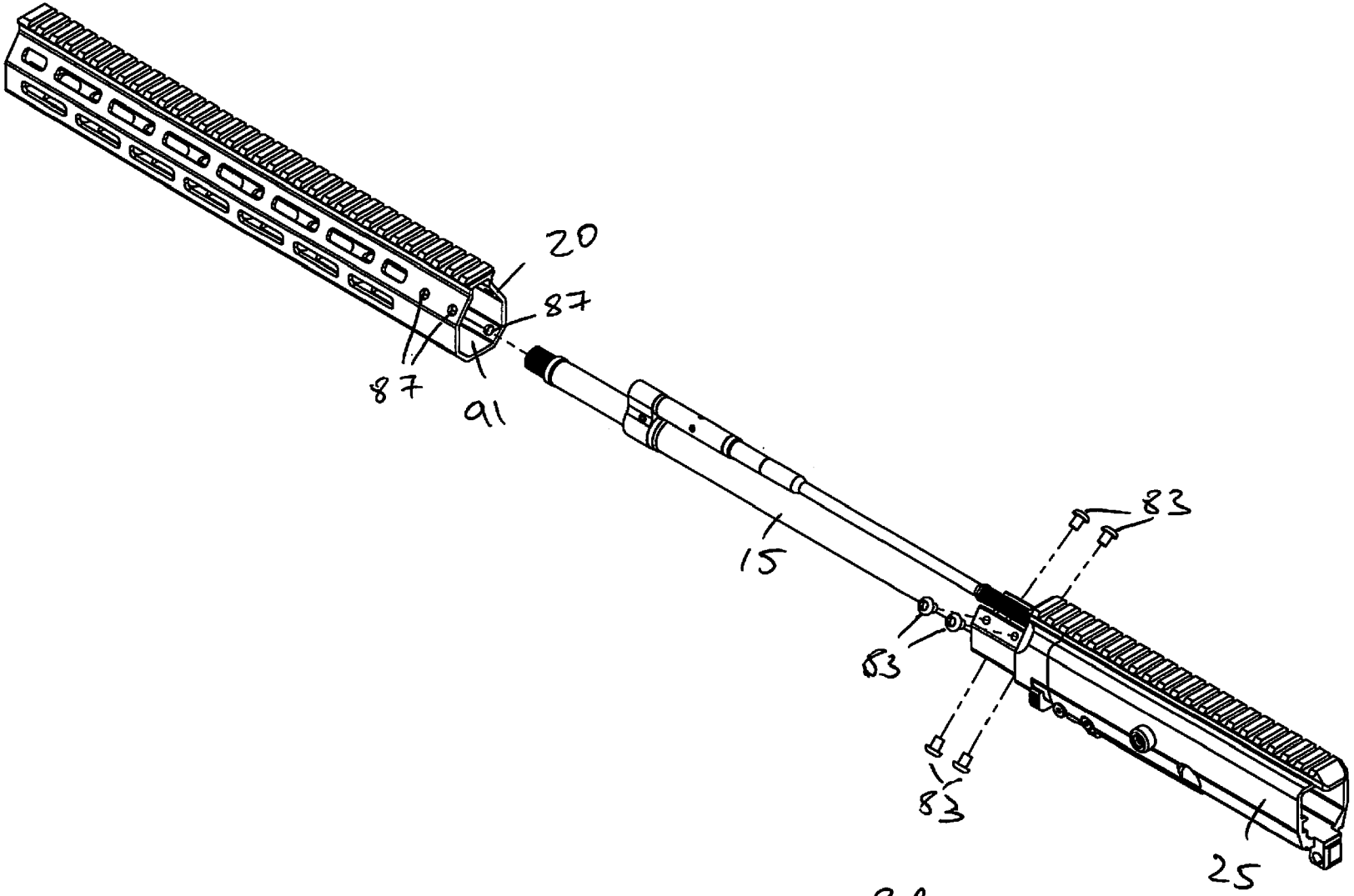
Figure 8C:
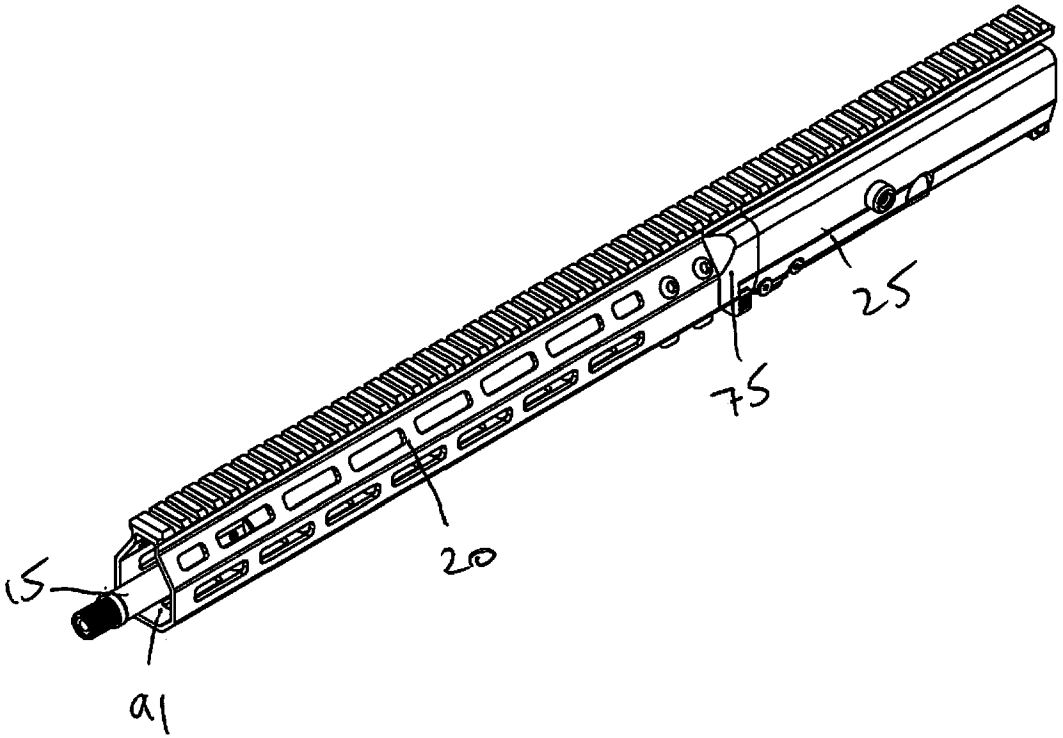
FIGS. 8*c-d* depict an assembled view of the upper receiver assembly in FIG. 8*a*.
Figure 8D:
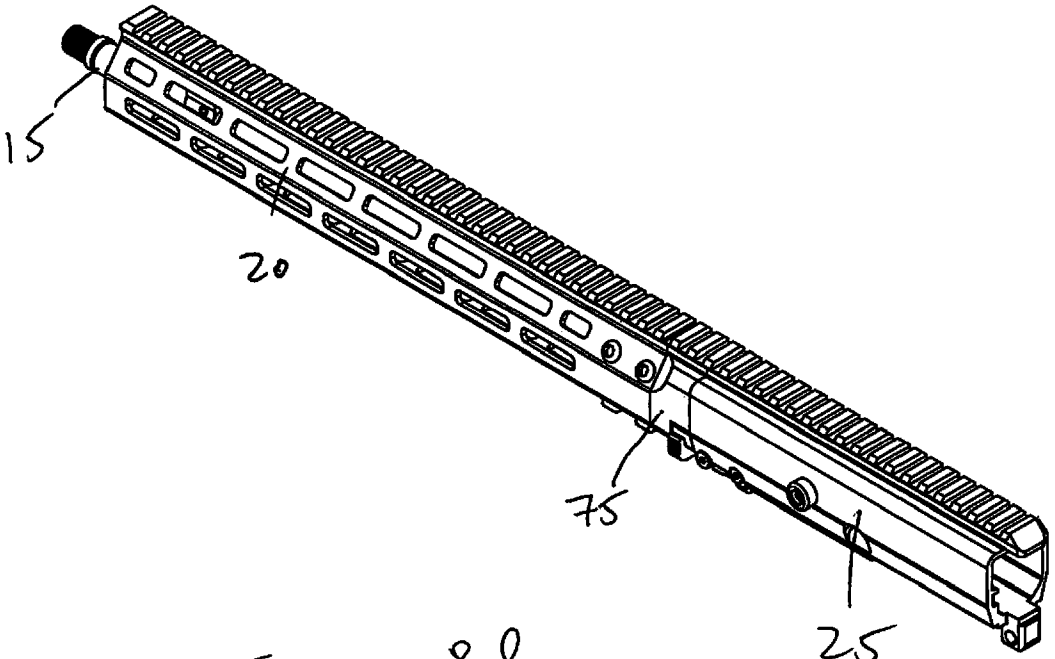

According to some embodiments, the handguard 20 comprises one or more apertures 87 and the handguard mounting block 75 comprises one or more apertures 89 configured to accommodate the one or more fasteners 83. According to some embodiments, the handguard mounting block 75 is at least partially enclosed by the handguard 20 as shown in FIGS. 8*c-d*. According to some embodiments, the handguard mounting block 75 is at least partially covered by the handguard 20 as shown in FIGS. 8*c-d*. According to some embodiments, the handguard mounting block 75 is at least partially surrounded by the handguard 20 as shown in FIGS. 8*c-d*.

According to some embodiments, the handguard 20 comprises an aperture 91 configured to accommodate the barrel 15. According to some embodiments, a second end 91 of the barrel 15 is inserted through the aperture 91. According to some embodiments, the aperture 91 configured to accommodate at least a portion of the handguard mounting block 75. According to some embodiments, the aperture 91 is a through-aperture (i.e. through opening).

Figure 9A:
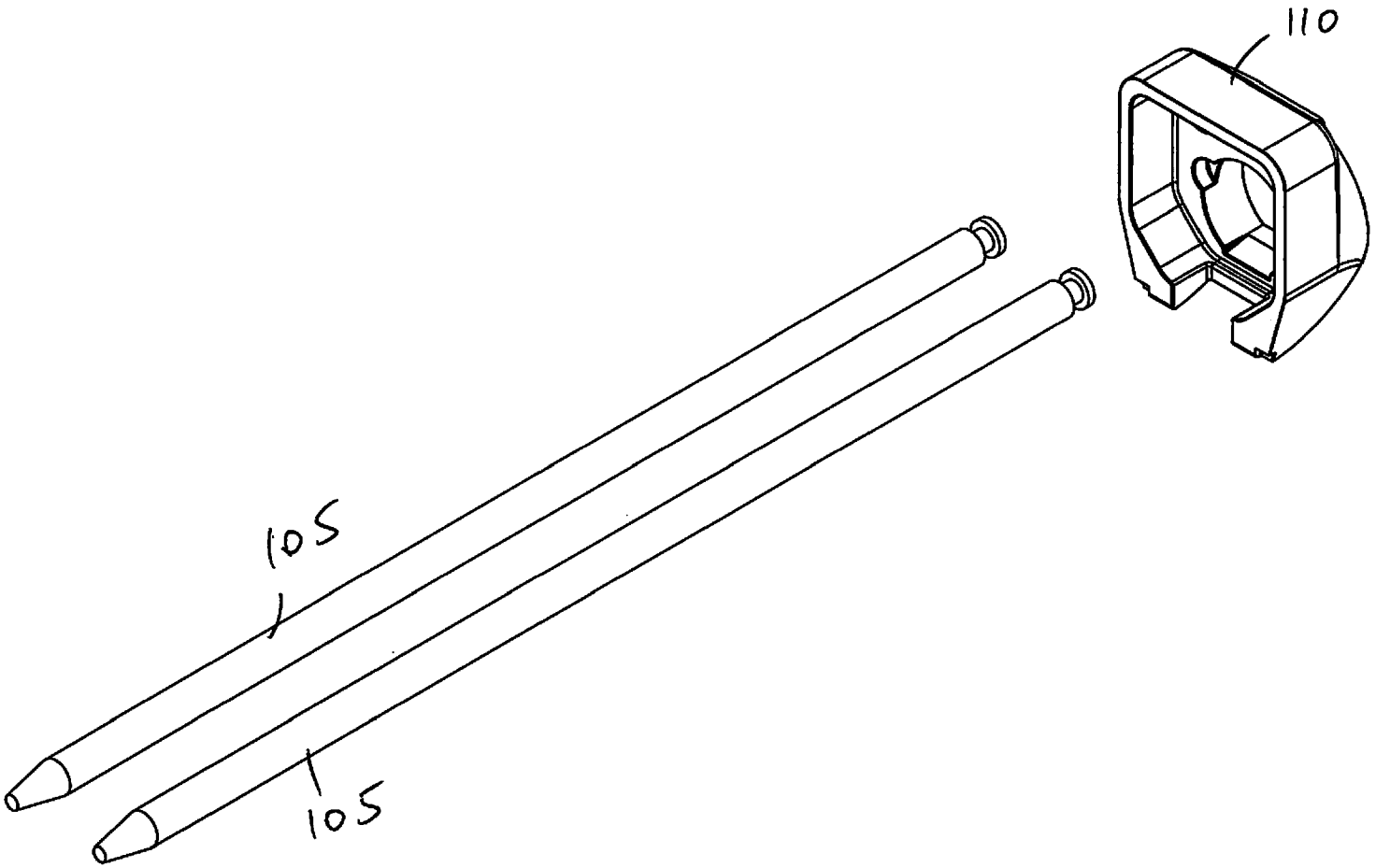
FIG. 9*a* depicts another exploded view of an upper receiver assembly according to some embodiments presently disclosed.
Figure 9B:
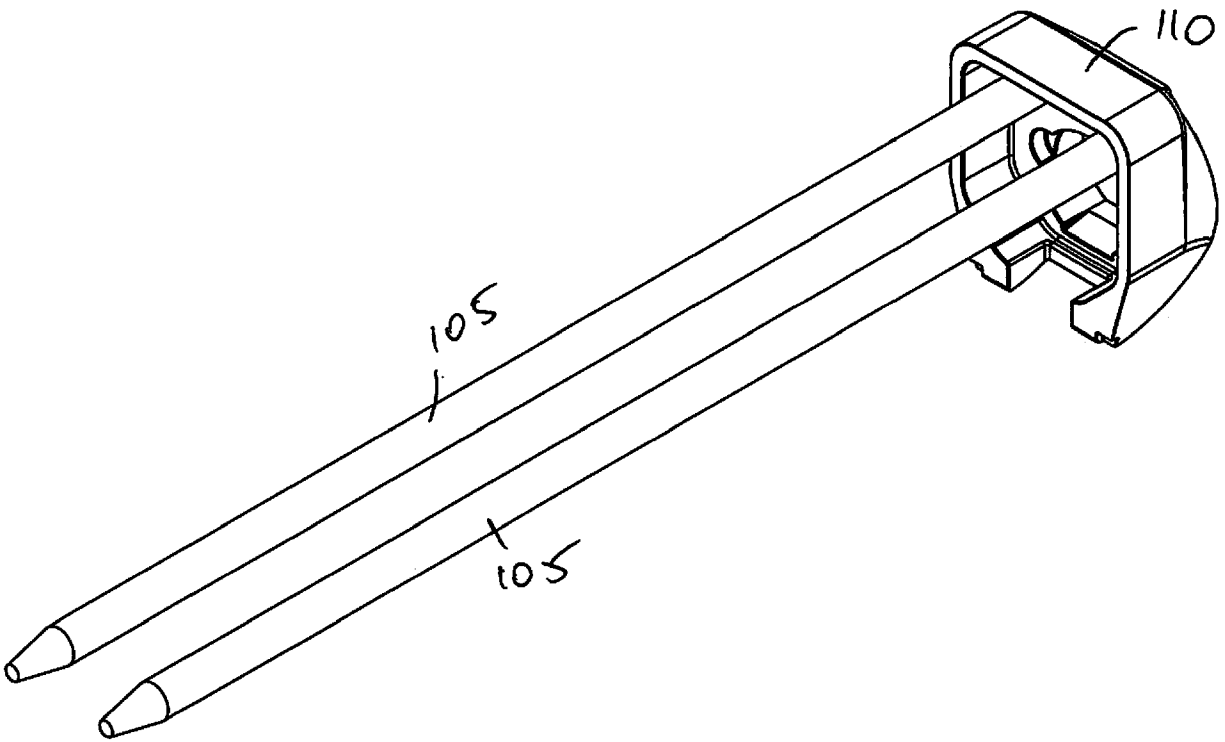
FIGS. 9*b-c* depict an assembled view of the upper receiver assembly in FIG. 9*a*.
Figure 9C:
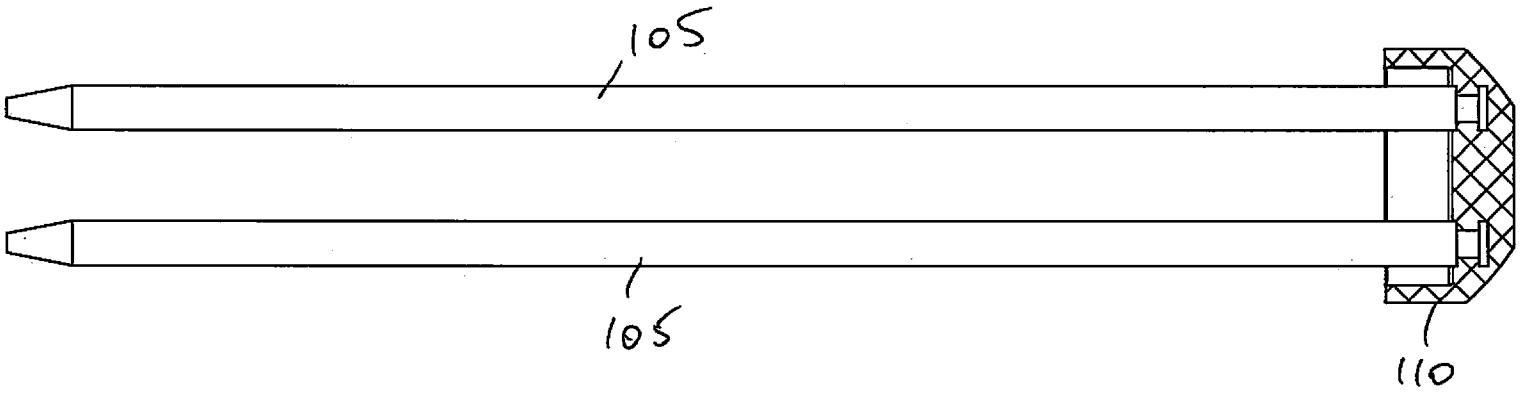

According to some embodiments, the upper receiver assembly 10 comprises a pair of guide rods 105 coupled with a rear recoil block 110 as shown in FIGS. 9*a-c*. According to some embodiments, the pair of guide rods 105 are permanently coupled with a rear recoil block 110. The pair of guide rods 105 may comprise metal material and the rear recoil block 110 may comprise polymer material. The pair of guide rods 105 may be permanently coupled with the rear recoil block 110 using overmolding process. The overmolding process may form the rear recoil block 110 over a portion of the pair of guide rods 105.

According to some embodiments, the upper receiver assembly 10 comprises a bolt carrier assembly 115 shown in FIGS. 10*a-e*. The bolt carrier assembly 115 comprises two through apertures 120 and 125 configured to accommodate the pair of guide rods 105 as shown in FIGS. 11*a-b*. According to some embodiments, the through apertures 120 and 125 are a through-openings.

According to some embodiments, the bolt carrier assembly 115 comprises an outer housing 130, a bolt 131, a firing pin 132, a spring 133, a cam pin 134, and a firing pin 135. The bolt carrier assembly 115 may also comprise a charging handle 136. According to some embodiments, the bolt 131 is at least partially positioned within the housing 130, the firing pin 132 is at least partially positioned within the housing 130, the spring 133 is positioned within the housing 130, the cam pin 134 is at least partially positioned within the housing 130, and the firing pin 135 is at least partially positioned within the housing 130.

According to some embodiments, the bolt carrier assembly 115 is configured to slide along the guide rods 105 between a first (i.e. locked) position and a second (i.e. unlocked) position. The bolt carrier assembly 115 supports and positions the bolt 131. The first (locked) position is position in which the bolt carrier assembly 115 has positioned the bolt 131 for firing ammunition through the barrel 15. The second (unlocked) position is any position other than the first (locked) position.

According to some embodiments, the upper receiver assembly 10 comprises a pair of recoil springs 140 as shown in FIGS. 11*a-b*. The recoil springs 140 may dampen the kickback experienced by a user while also redirecting the bolt carrier assembly 115 back toward the first (locked) position in preparation for firing another round.

According to some embodiments presently disclosed, the guide rods 105 pass through the recoil springs 140 shown in FIGS. 11*a-b*. According to some embodiments presently disclosed, the recoil springs 140 are positioned between the bolt carrier assembly 115 and the rear recoil block 110.

According to some embodiments presently disclosed, moving the bolt carrier assembly 115 towards the second (unlocked) position compresses the recoil springs 140 between the bolt carrier assembly 115 and the rear recoil block 110. According to some embodiments presently disclosed, applying a first force to the bolt carrier assembly 115 compresses the recoil springs 140 between the bolt carrier assembly 115 and the rear recoil block 110. Removing the first force causes the compressed recoil springs 140 to move the bolt carrier assembly 115 towards the first (locked) position.

Figure 13:
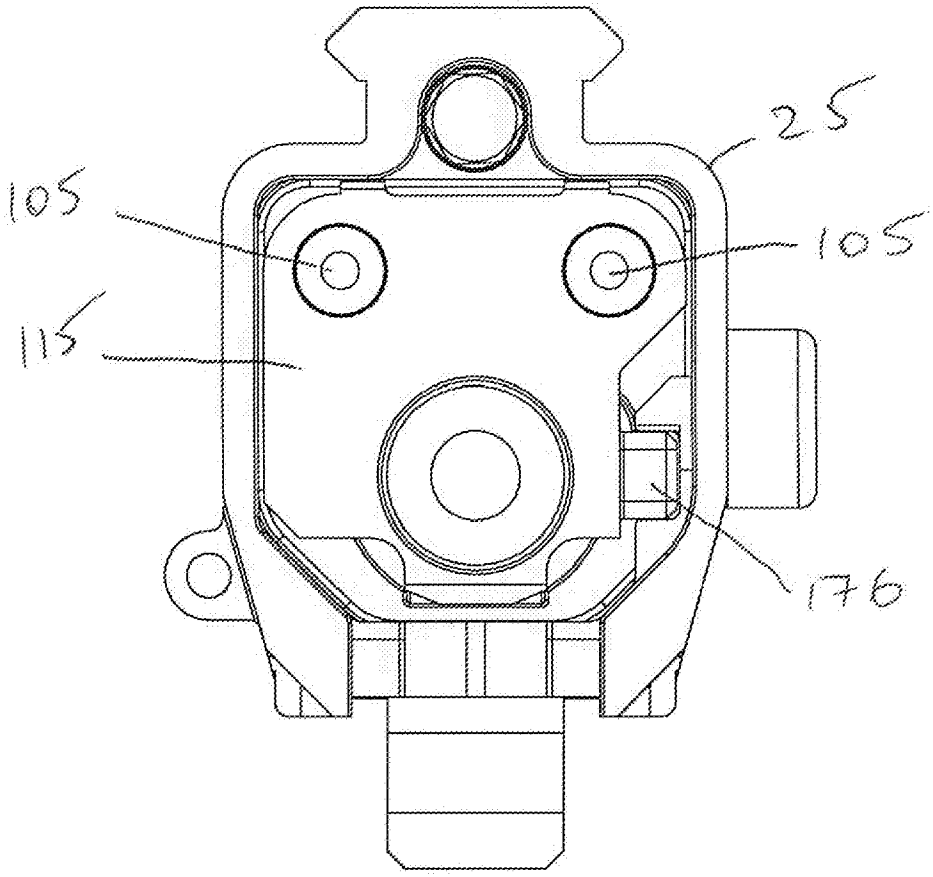
FIG. 13 depicts another embodiment presently disclosed.

According to some embodiments presently disclosed, the upper receiver 25 comprises a through aperture 165 configured to accommodate the bolt carrier assembly 115, the recoil springs 140, and the guide rods 105 as shown in FIGS. 12*a-b* and 13. According to some embodiments presently disclosed, the rear recoil block 110 abuts the upper receiver 25 when the bolt carrier assembly 115, the recoil springs 140, and the guide rods 105 are positioned within the aperture 165 as shown in FIG. 12*b*. According to some embodiments presently disclosed, the rear recoil block 110 sandwiched between the upper receiver 25 and the lower receiver 26 when the upper receiver 25 is coupled with the lower receiver 26. According to some embodiments presently disclosed, the rear recoil block 110 sandwiched between the upper receiver 25 and the upwardly extending lobe 28 when the upper receiver 25 is coupled with the lower receiver 26. According to some embodiments presently disclosed, the rear recoil block 110 is not coupled with the upper receiver 25 when the bolt carrier assembly 115, the recoil springs 140, and the guide rods 105 are positioned within the aperture 165 as shown in FIG. 12*b*.

According to some embodiments presently disclosed, the rear recoil block 110 is partially inserted into the aperture 165 of the upper receiver 25 when the bolt carrier assembly 115, the recoil springs 140, and the guide rods 105 are positioned within the aperture 165 as shown in FIG. 12*b*. According to some embodiments, the through aperture 165 is through opening.

Figure 14A:
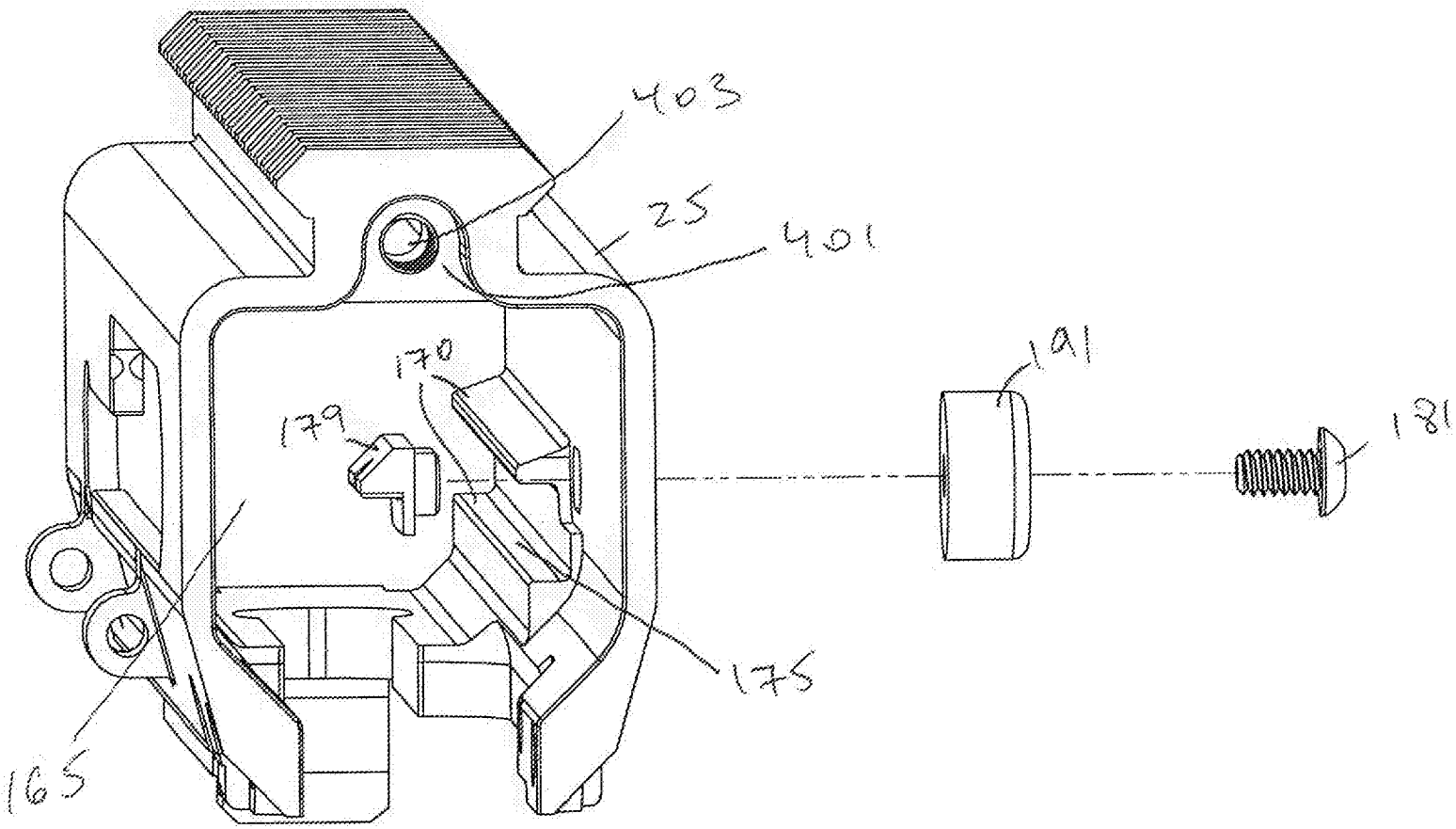
FIGS. 14*a-c* depict another embodiment presently disclosed.
Figure 14B:
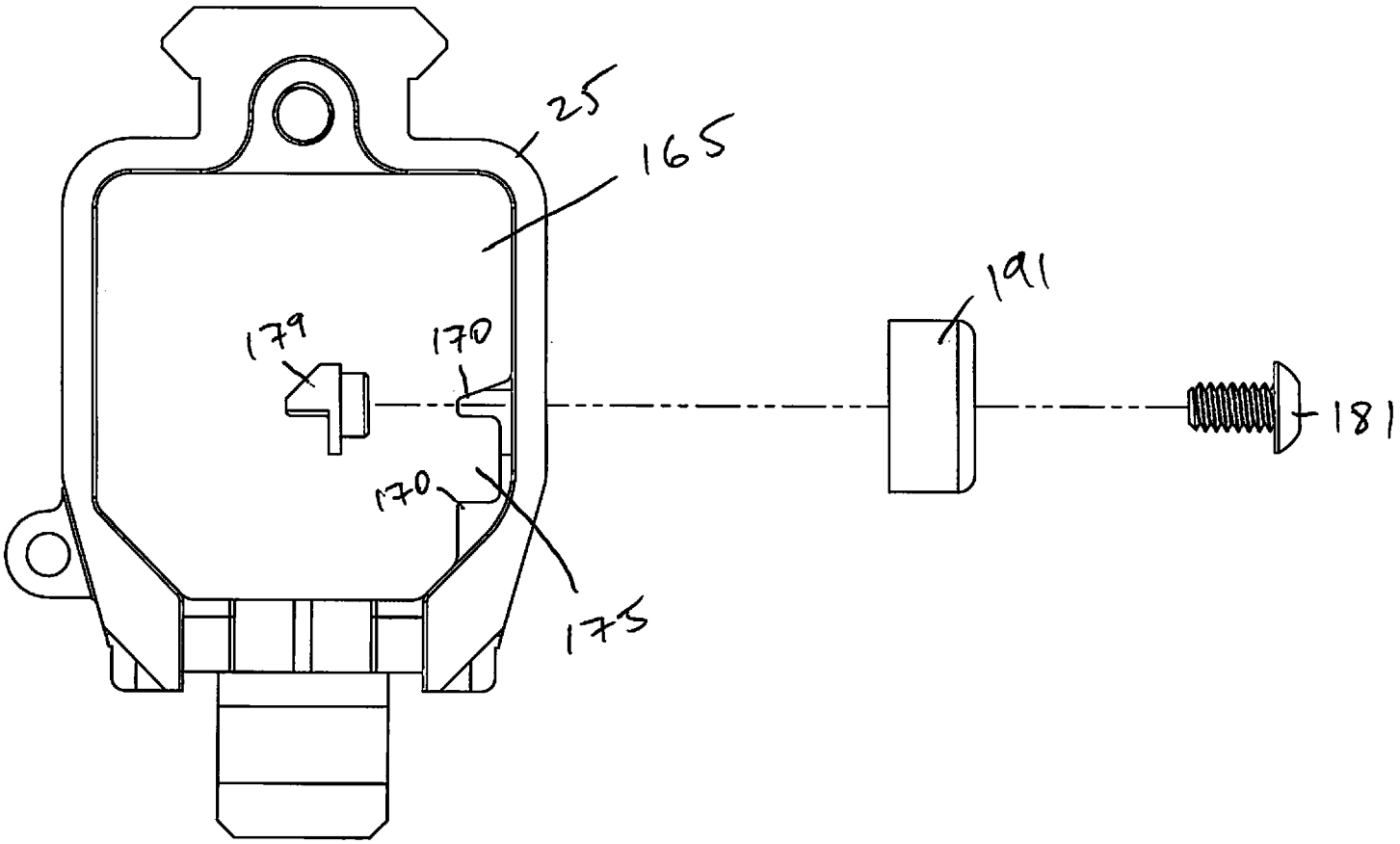
Figure 14C:
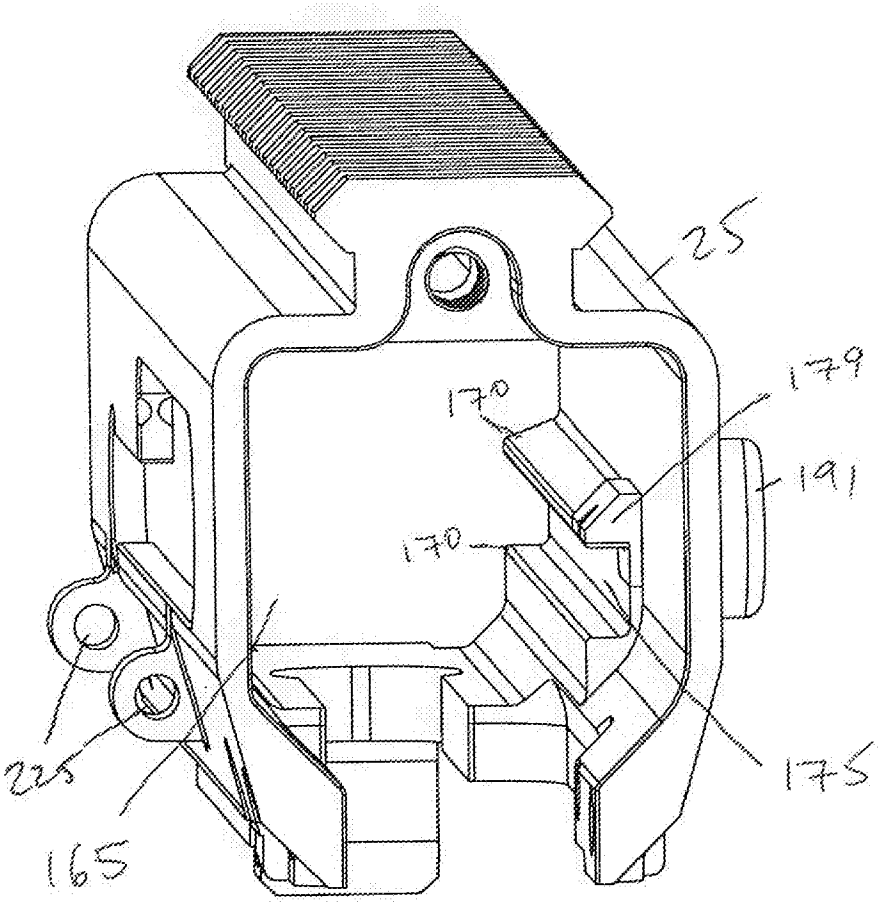

According to some embodiments presently disclosed, the upper receiver 25 comprises one or more protrusions 170 extending into the aperture 165 as shown in FIGS. 14*a-c*. According to some embodiments presently disclosed, the one or more protrusions 170 are formed during manufacturing of the upper receiver 25. According to some embodiments presently disclosed, the one or more protrusions 170 are extruded during manufacturing of the upper receiver 25. According to some embodiments presently disclosed, the one or more protrusions 170 run along a portion of the upper receiver 25.

According to some embodiments presently disclosed, the one or more protrusions 170 form a channel 175 (shown in FIG. 14*b*) configured to accommodate the one or more protrusions 176 extending from the bolt carrier assembly 115 as shown in FIGS. 11*a* and 13. According to some embodiments presently disclosed, the channel 175 run along the entire length of the one or more protrusions 170 as shown in FIGS. 14*a* and 14*c*. The protrusions 176 is configured to slide within the channel 175 from a first (locked) position to a second (unlocked) position and back to the first (locked) position.

According to some embodiments, the upper receiver assembly 10 comprises a cam slot 179 removably coupled to the side wall of the aperture 165 using a fastener 181 as shown in FIGS. 14*a-c*. The cam slot 179 aligns with a top protrusion 170 to prevent the cam pin 134 from impacting the top protrusion 170 during normal operations of the firearm 27. The cam slot 179 aligns with a top protrusion 170 to prevent the cam pin 134 from damaging the top protrusion 170 during normal operations of the firearm 27. According to some embodiments, the one or more protrusions 170 are formed using aluminum material and the cam slot 179 is formed using steel material. According to some embodiments, the upper receiver 25 is formed using aluminum material and the cam slot 179 is formed using steel material.

Figure 15A:
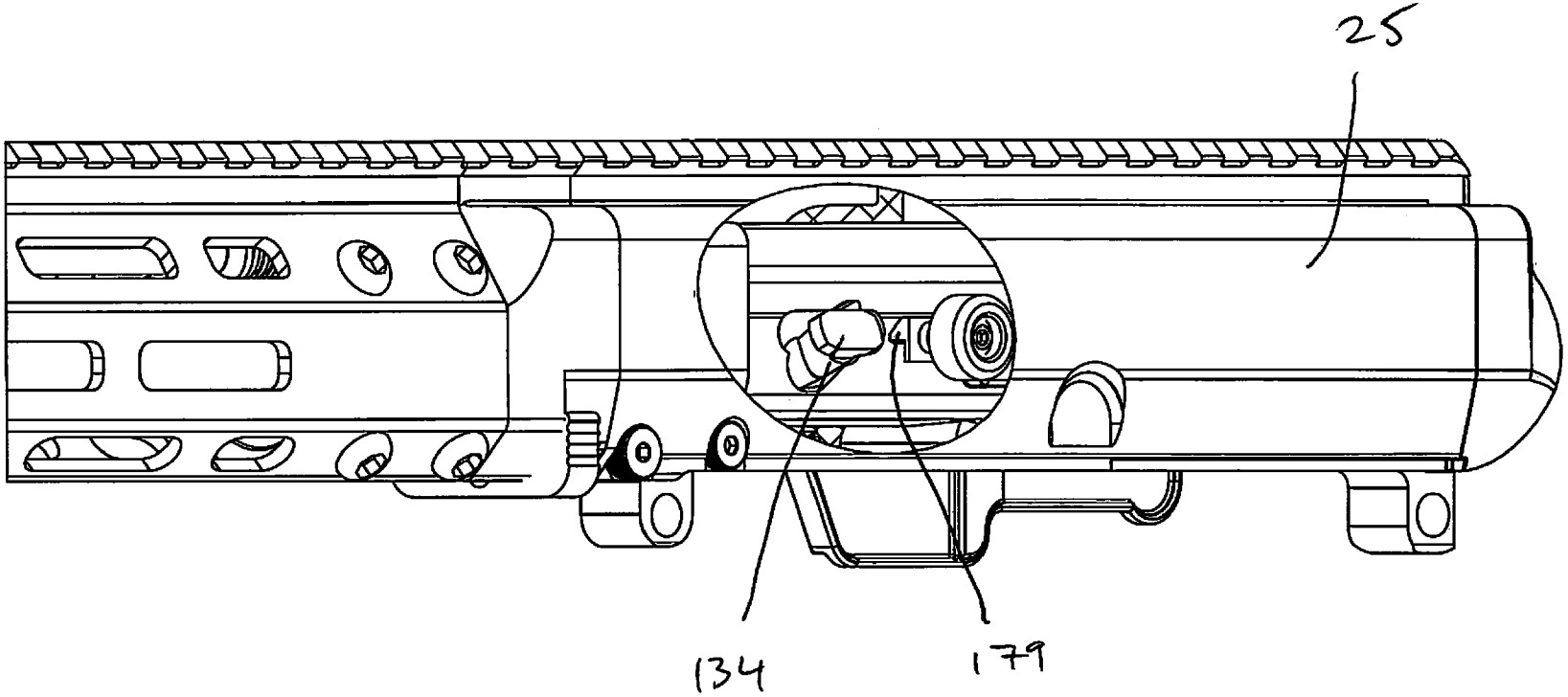
FIGS. 15*a-b* depict another embodiment presently disclosed.
Figure 15B:
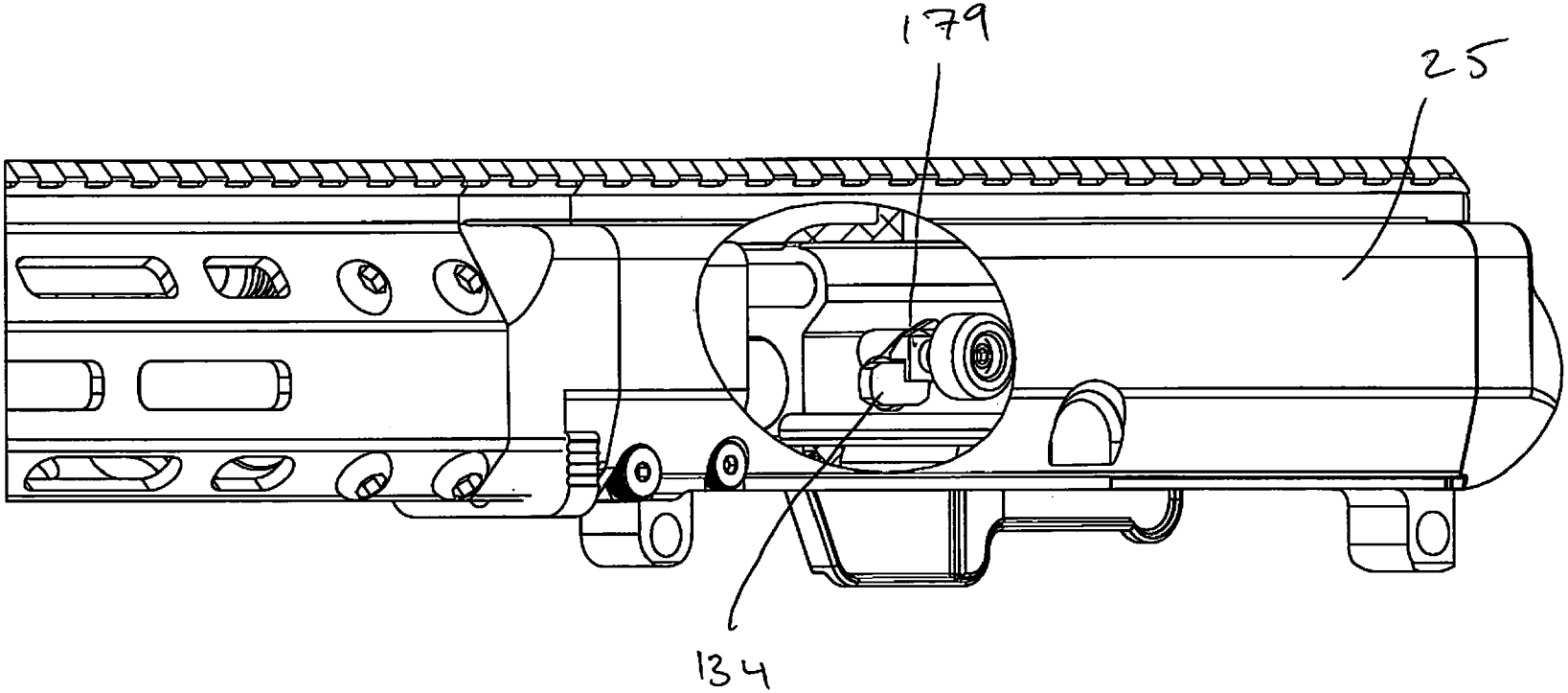

According to some embodiments, the cam pin 134 is configured to move between a first (up) position and a second (down) position. According to some embodiments, the cam pin 134 may move from the second (down) position to the first (up) position (shown in the FIG. 15*a*) during normal operations of the firearm 27. To avoid damaging the top protrusion 170, the cam slot 179 is configured to reposition the cam pin 134 back to the second (down) position (as shown in FIG. 15*b*).

According to some embodiments, the cam slot 179 comprises a profile that is substantially similar to a profile of the top protrusion 170 as shown in FIG. 14*c*.

According to some embodiments, the upper receiver assembly 10 comprises an insert bumper 191 removably coupled with the upper receiver 25 using the fastener 181 as shown in FIGS. 14*a-c*. The insert bumper 191 may be used to prevent foldable stock (not shown) from damaging the firearm 27 when the foldable stock is folded to one side of the firearm 27.

According to some embodiments presently disclosed, the upper receiver 25 comprises a cavity 401 configured to accommodate the protrusion 355 of the extension block 50. According to some embodiments presently disclosed, the upper receiver 25 comprises an aperture 403 configured to accommodate the first end 56 of the handguard mounting fastener 57.

As described above, the handguard mounting block 75 comprises the aperture 81 configured to accommodate the slide lock plate 76 as shown in FIGS. 7*e-f*. According to some embodiments, the slide lock plate 76 comprises the inner surface 82 configured to abut the barrel 15 and prevent the handguard mounting block 75 from being removed from the barrel 15. According to some embodiments, the inner surface 82 a tight fit around a portion of the barrel 15 to prevent the handguard mounting block 75 from being removed from the barrel 15.

According to some embodiments, the guide rods 105 prevent removal of the slide lock plate 76 from the aperture 81. After the handguard mounting block 75 is inserted into the aperture 81, the guide rods 105 are inserted into the upper receiver and interact with the slide lock plate 76 to prevent the slide lock plate 76 from being removed as shown in FIGS. 16*a-d*.

Figure 16A:
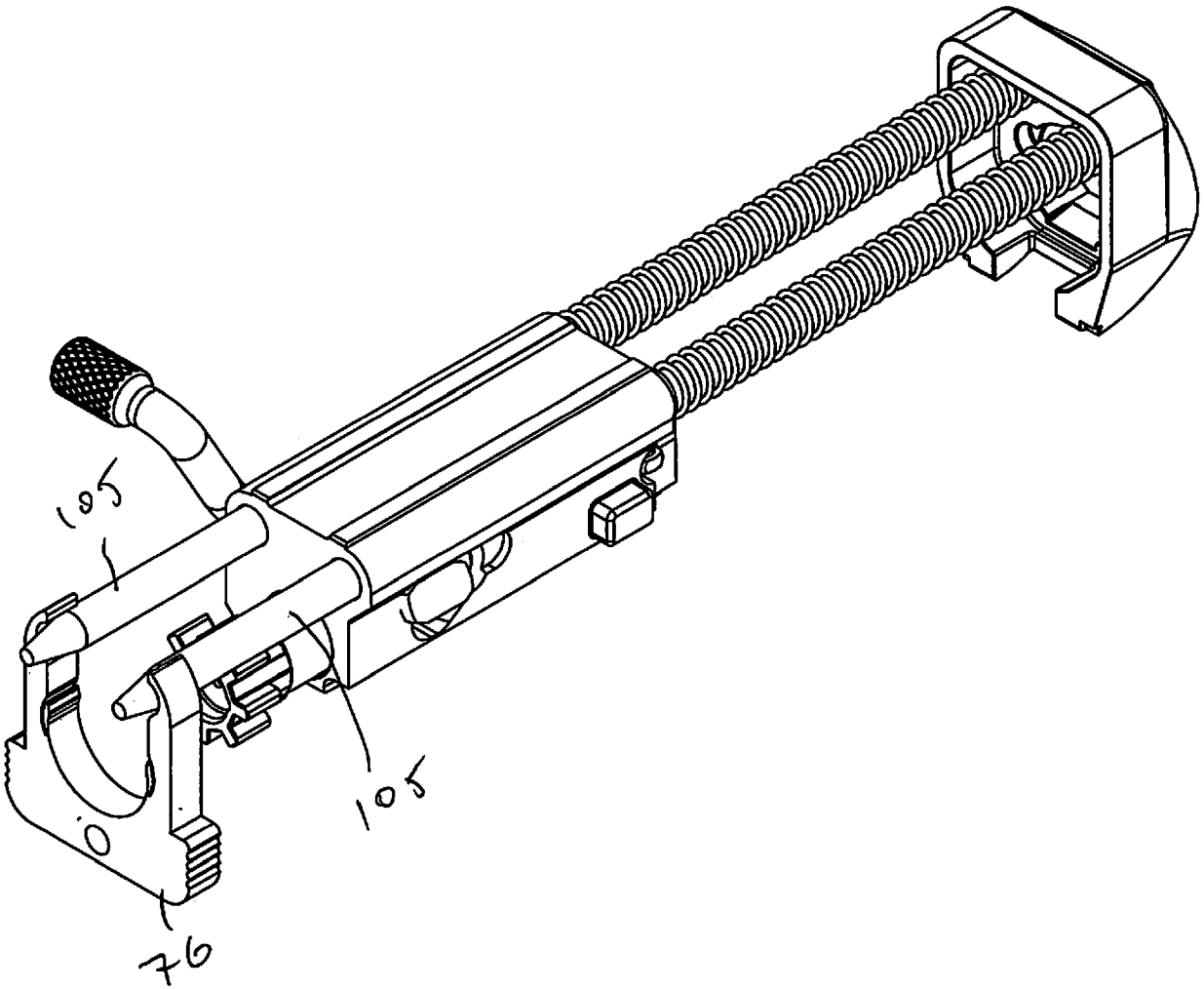
FIGS. 16*a-d* depict another embodiment presently disclosed.
Figure 16B:
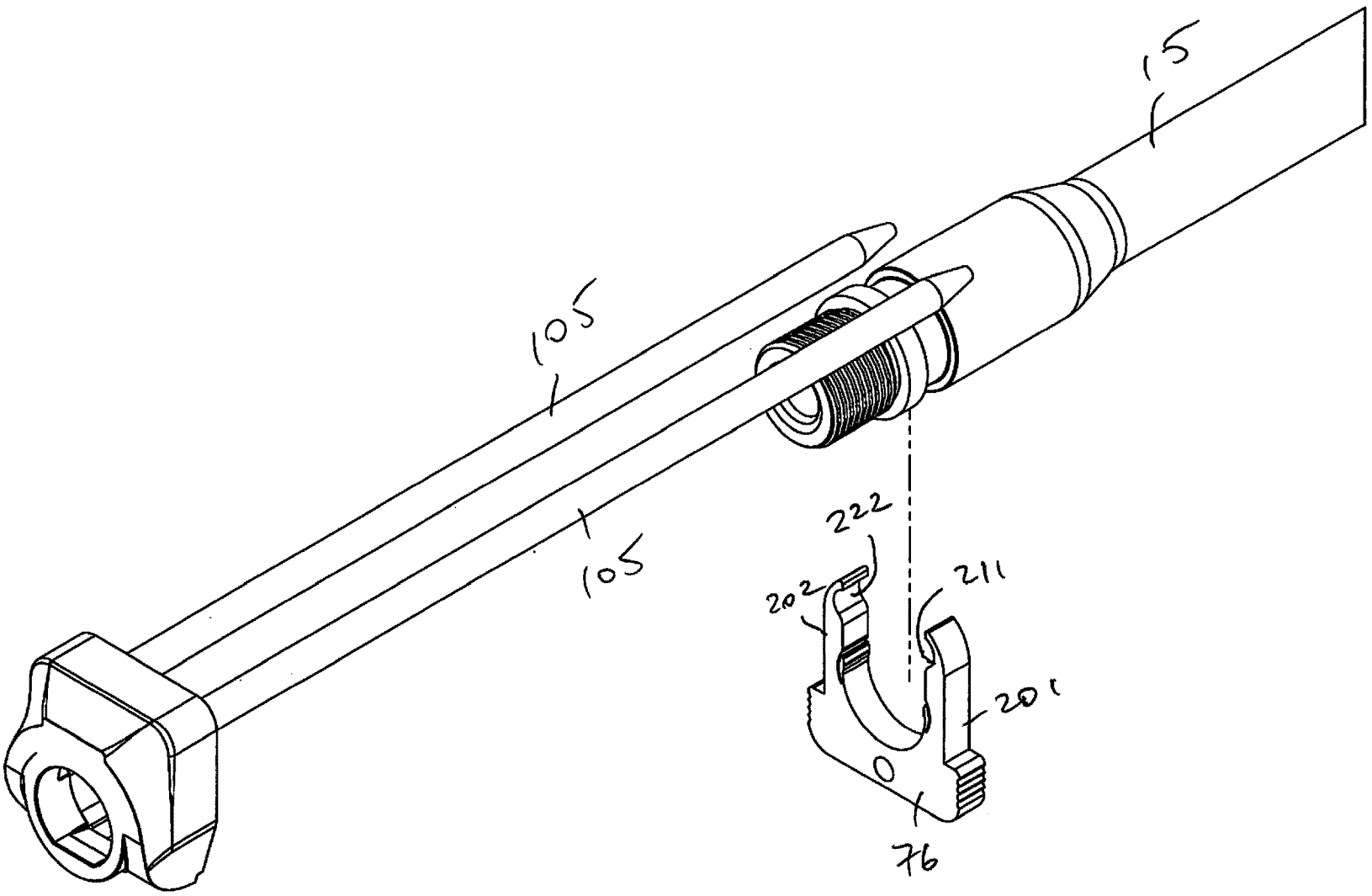
Figure 16C:
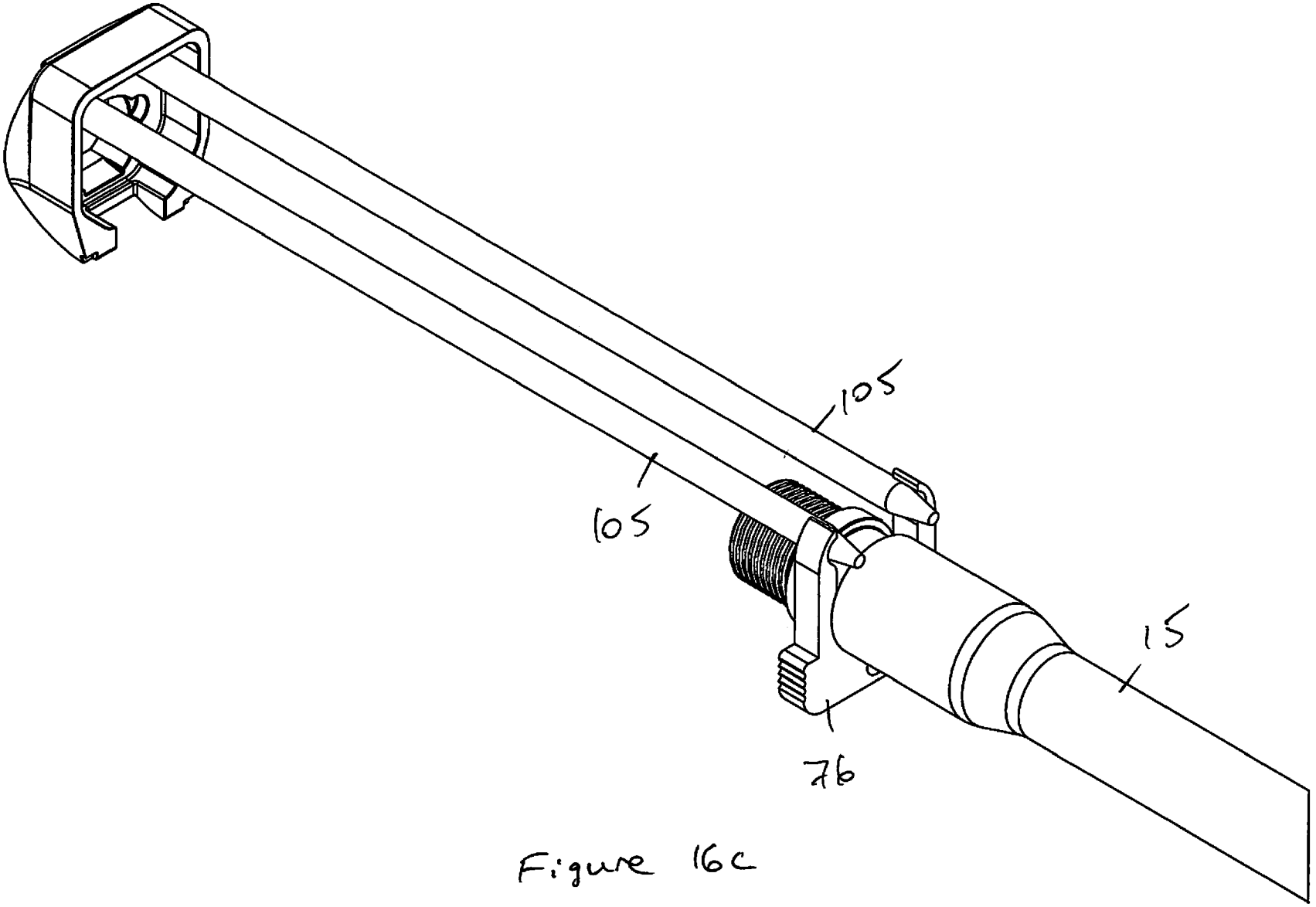
Figure 16L:
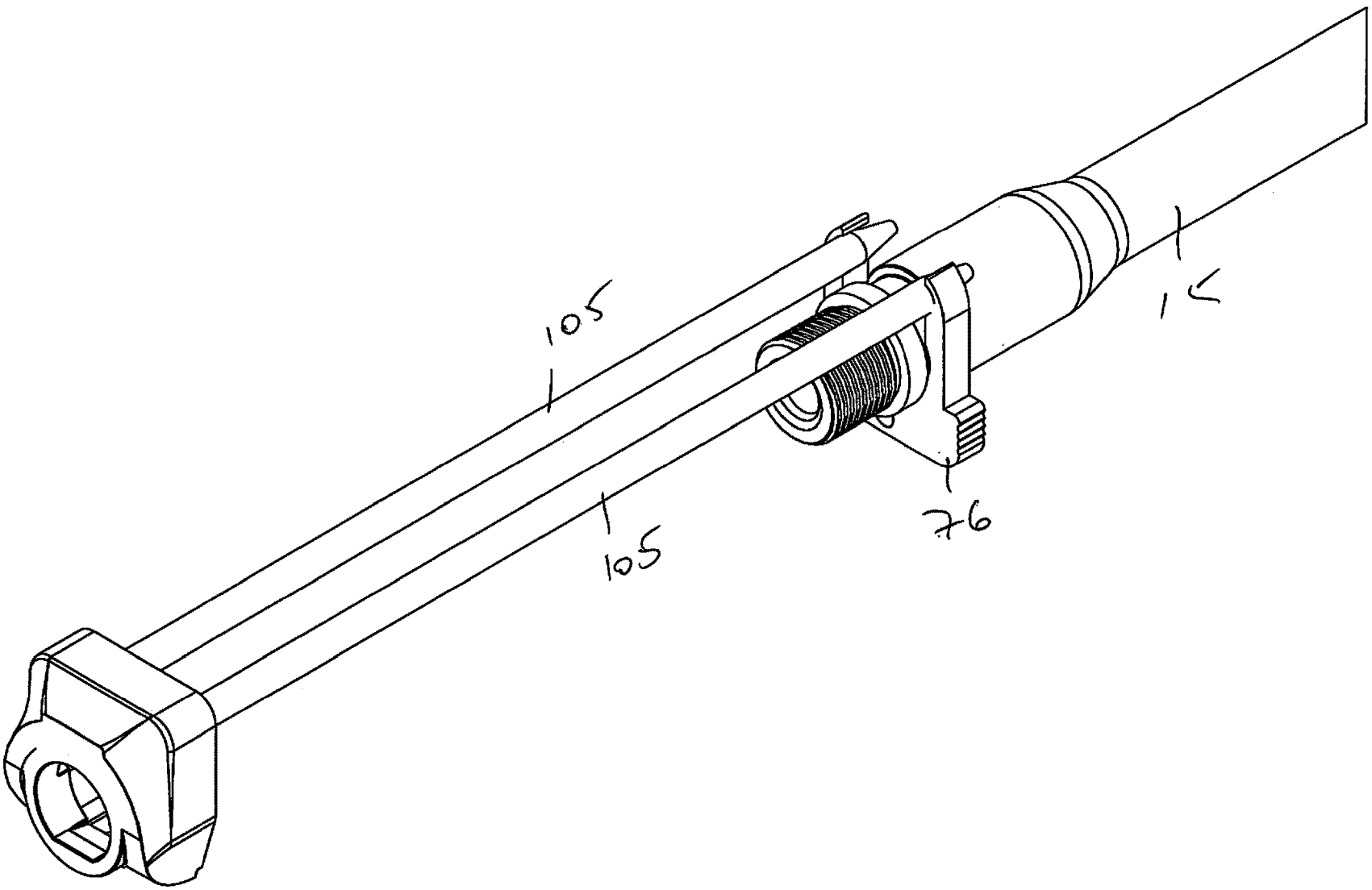

According to some embodiments, the slide lock plate 76 comprises arms 201 and 202 as shown in FIG. 16*b*. The arms 201 and 202 may comprise curved surfaces 211 and 222 configured to accommodate the guide rods 105. According to some embodiments, the guide rods 105 must be at least partially removed from the upper receiver 25 to allow removal of the slide lock plate 76 from the aperture 81.

Figure 17A:
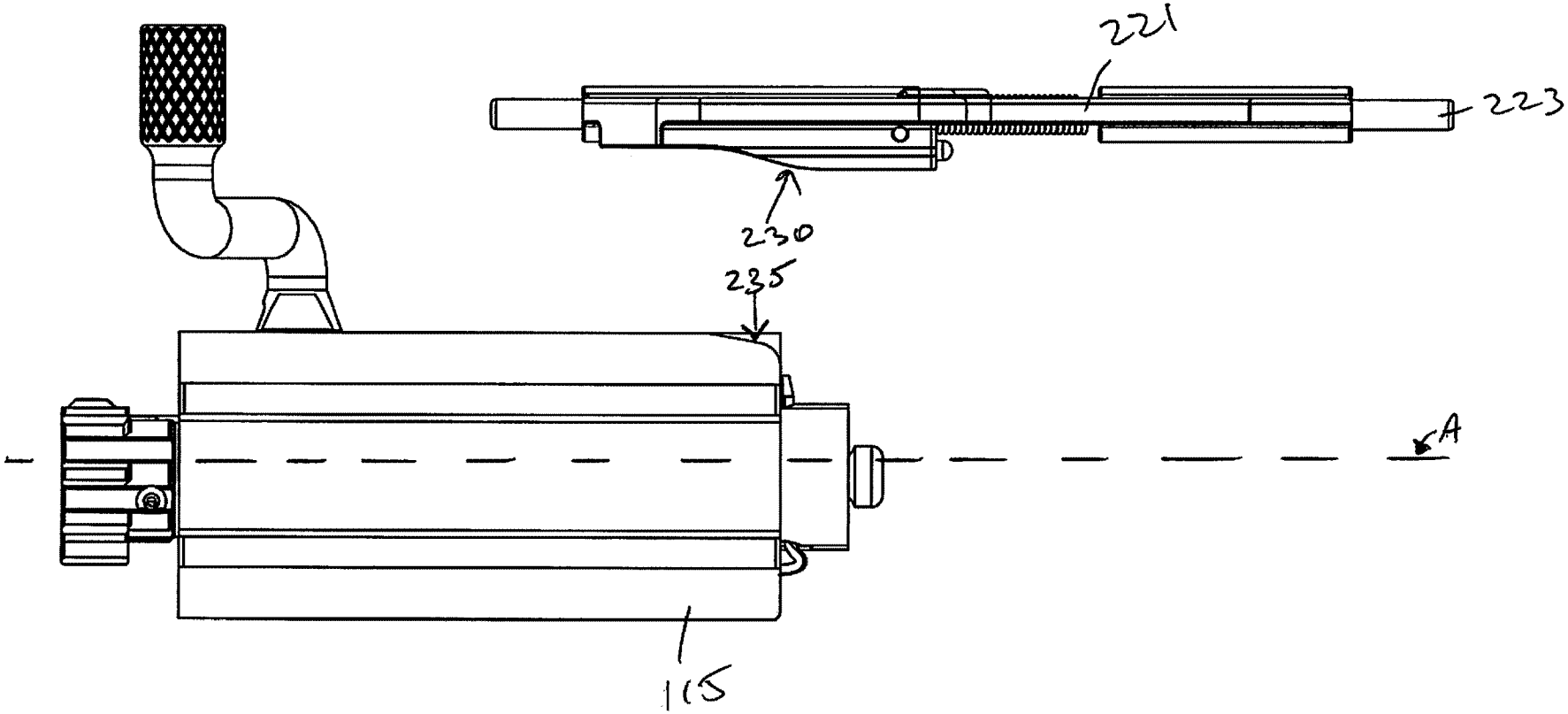
FIGS. 17*a-b* depict another embodiment presently disclosed.
Figure 17B:
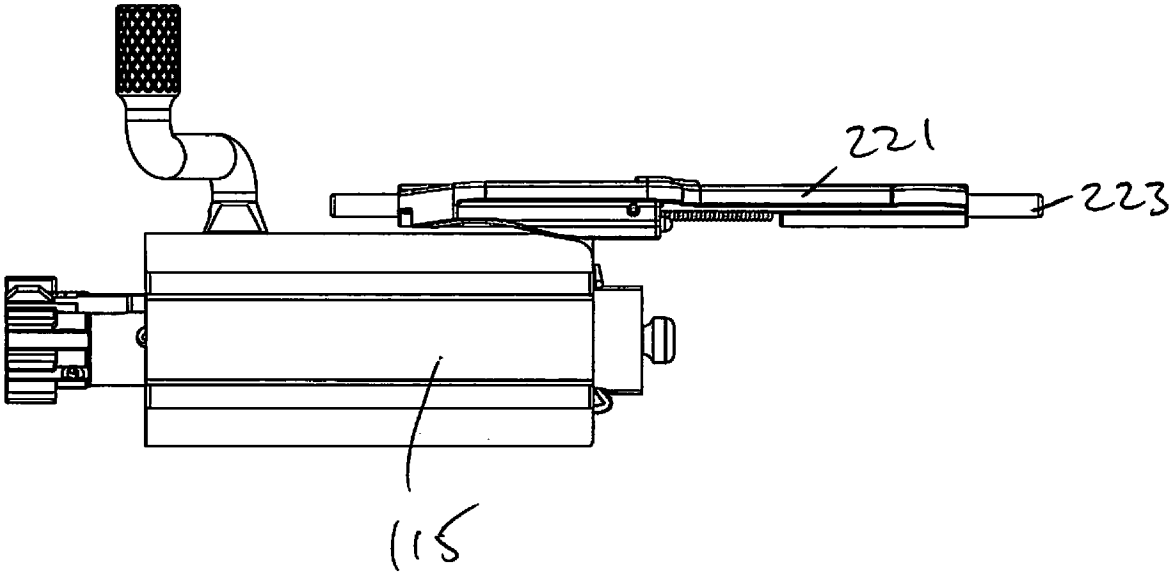

According to some embodiments, the upper receiver assembly 10 comprises a dust cover 221 pivotally coupled with the upper receiver 25 using a dust door pin 223 as shown in FIGS. 12*a* and 17*a-b*. According to some embodiments, the dust cover 221 pivotally coupled with apertures 225 of the upper receiver 25 shown in FIG. 14*c*.

Figure 10A:
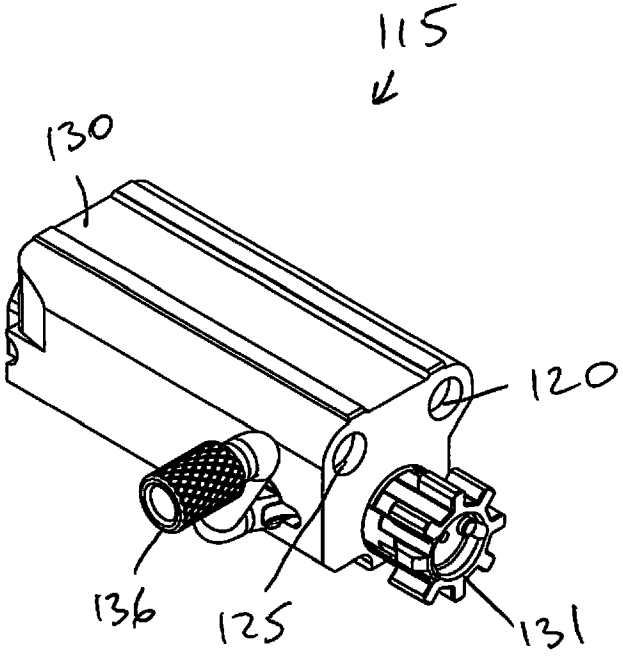
FIGS. 10*a-c* depict an assembled view of a bolt carrier assembly according to some embodiments presently disclosed.
Figure 10B:
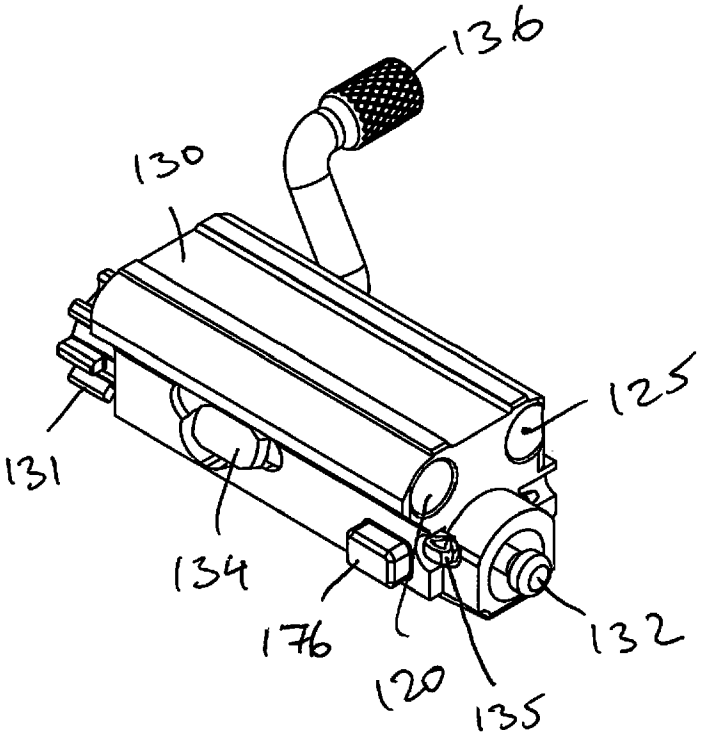
Figure 10C:
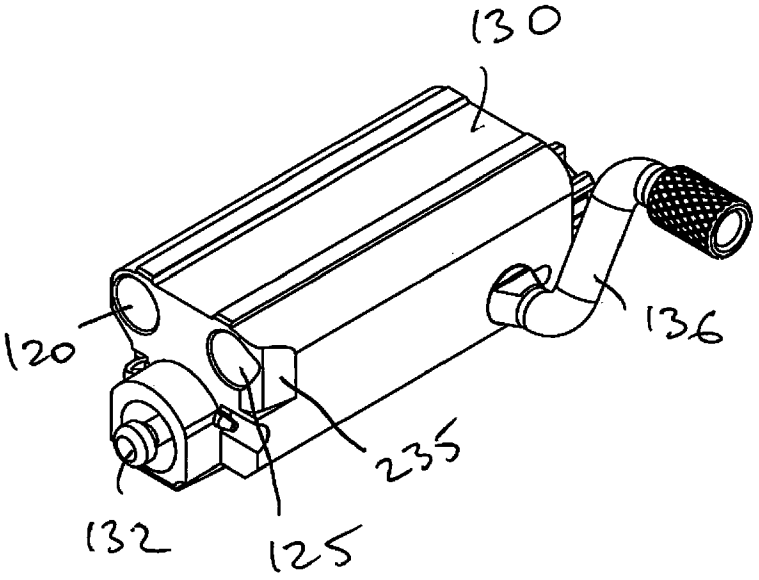
Figure 10D:
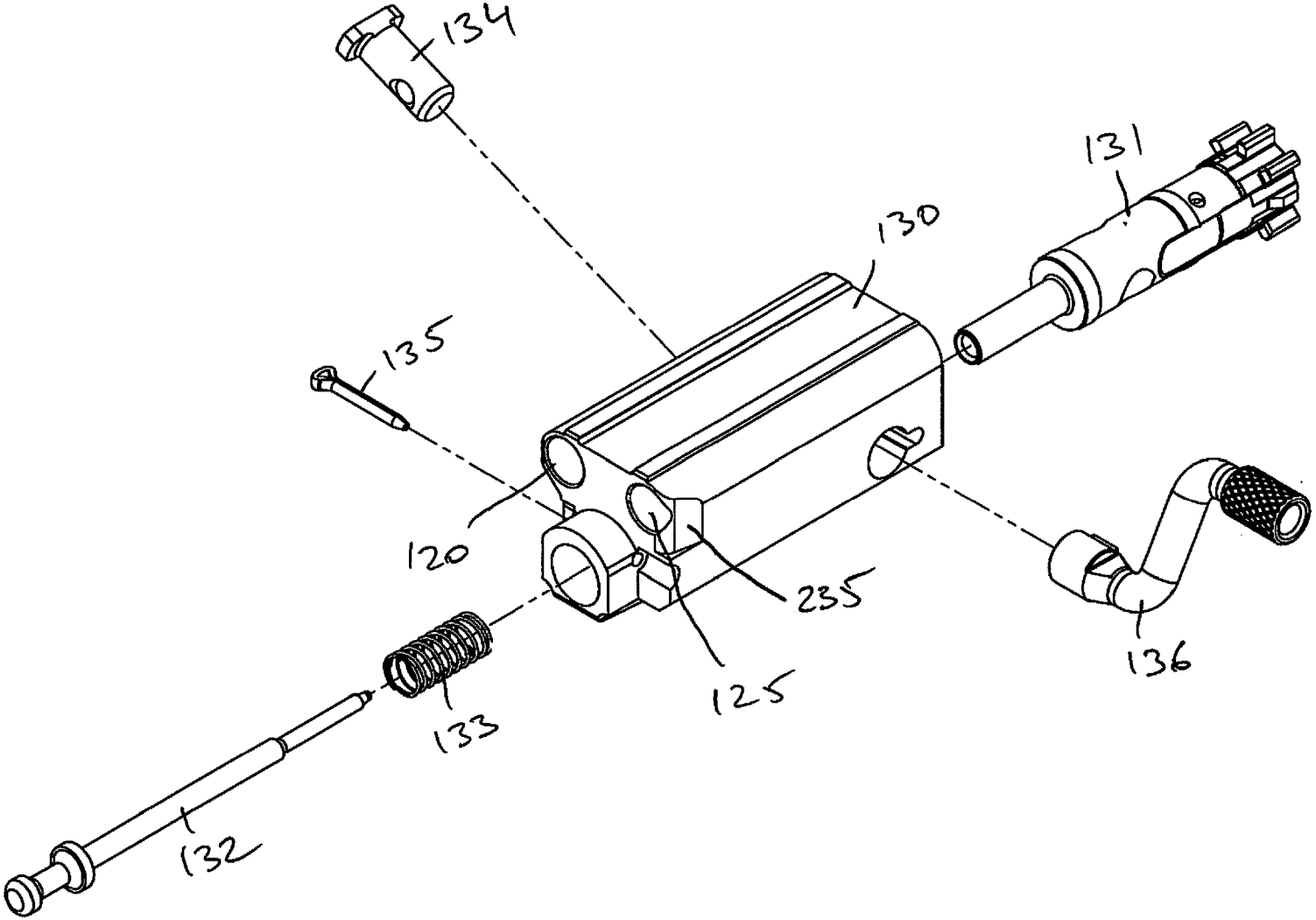
FIGS. 10*d-e* depict an exploded view of the bolt carrier assembly in FIG. 10*a*.
Figure 10E:
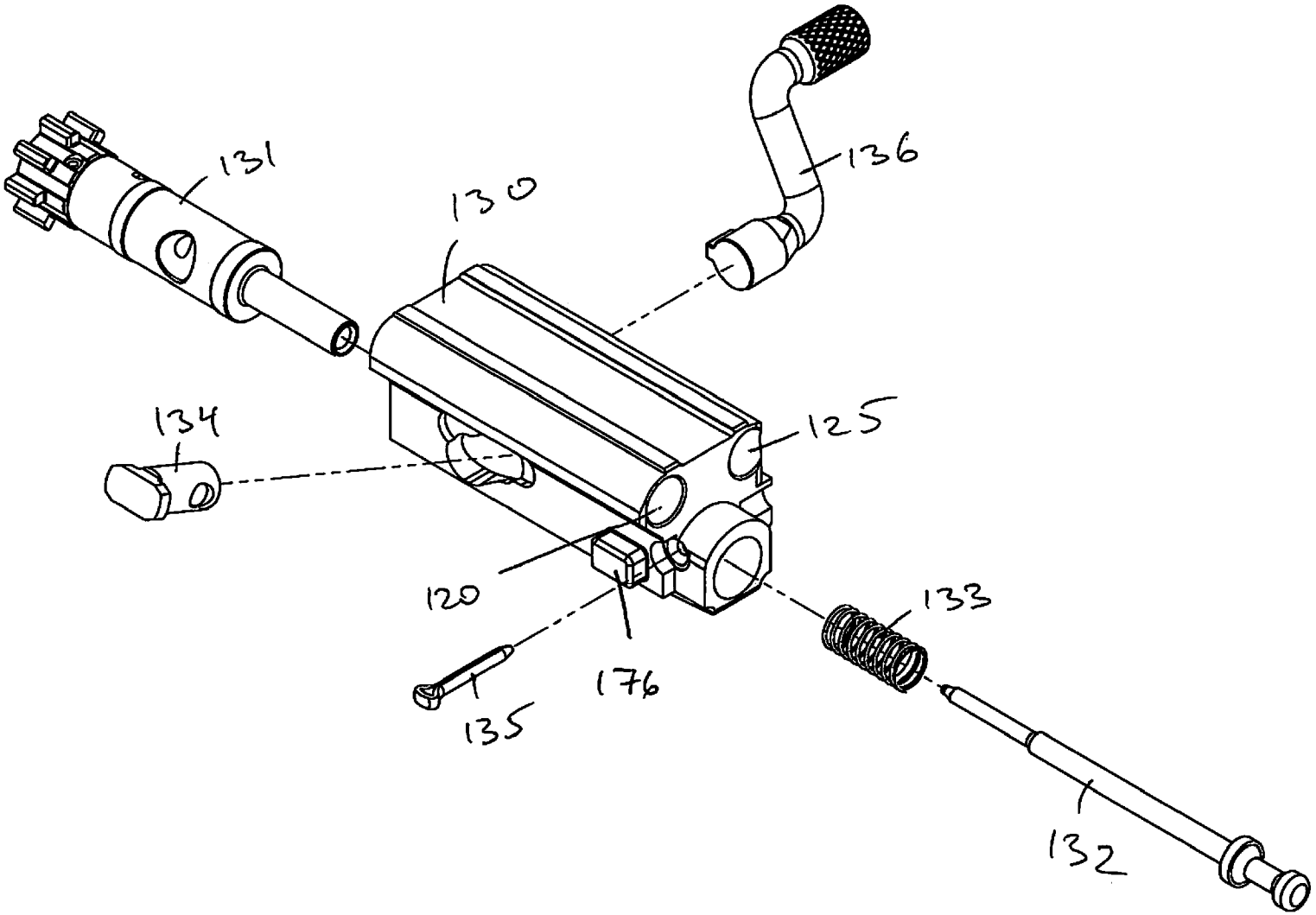
Figure 11A:
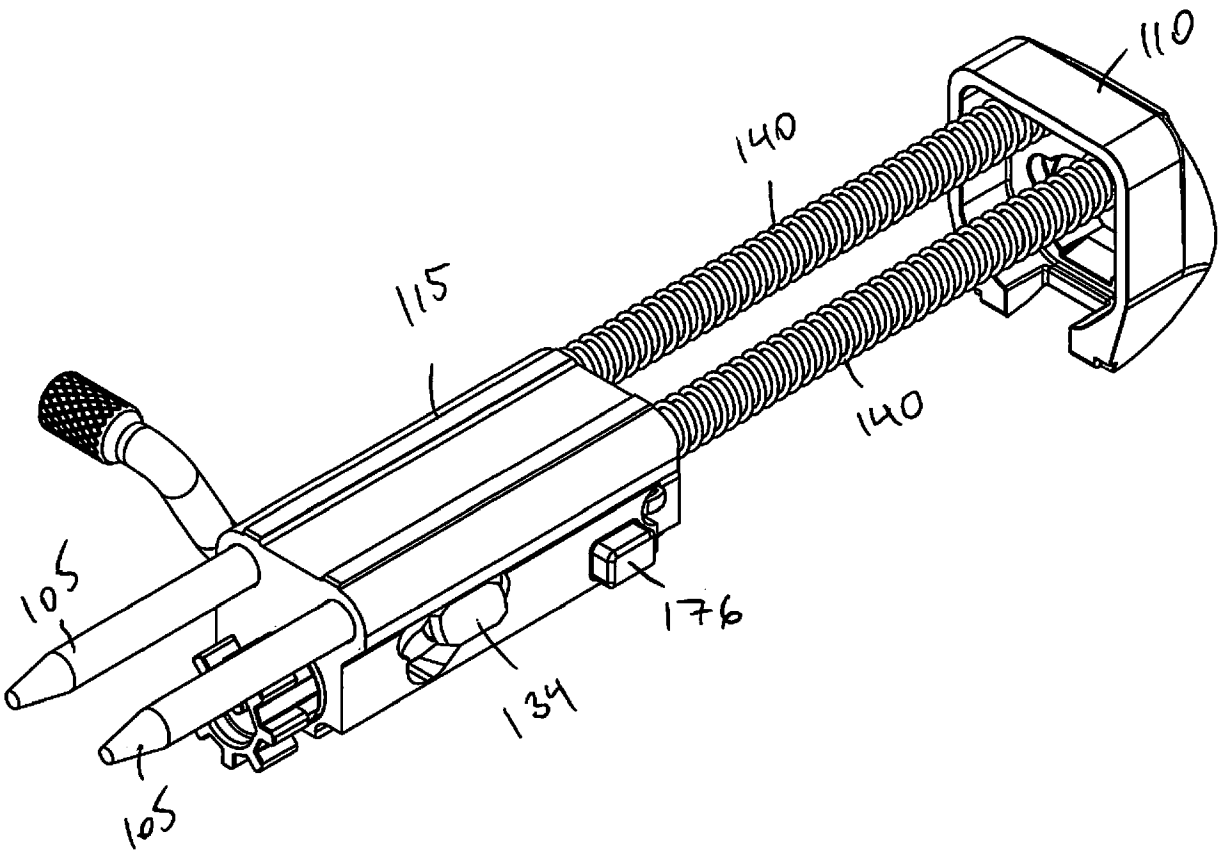
FIGS. 11*a-b* depict another embodiment presently disclosed.
Figure 11B:
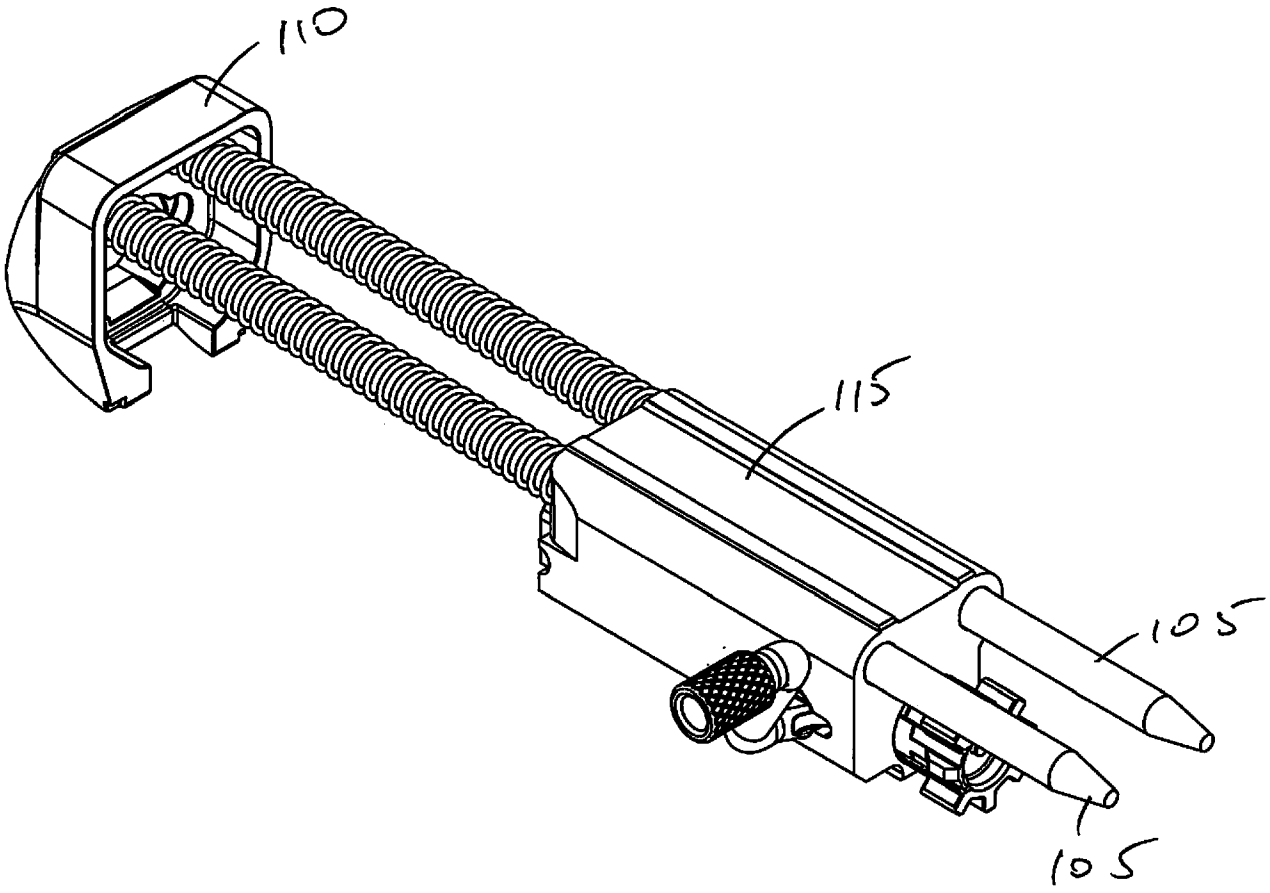

According to some embodiments, the dust cover 221 comprises a ramping surface 230 (shown in FIG. 17*a*) configured to interact with a ramping surface 235 of the bolt carrier assembly 115 (shown in FIGS. 10*c-d* and 17*a*). According to some embodiments, the ramping surface 235 of the bolt carrier assembly 115 interacts with the ramping surface 230 of the dust cover 221 when the bolt carrier assembly 115 moves from the first (i.e. locked) position and the second (i.e. unlocked) position. According to some embodiments, the ramping surface 235 of the bolt carrier assembly 115 moves the dust cover 221 away from the upper receiver 25 when the bolt carrier assembly 115 moves from the first (i.e. locked) position and the second (i.e. unlocked) position. According to some embodiments, the ramping surface 235 of the bolt carrier assembly 115 unlocks the dust cover 221 from the upper receiver 25 when the bolt carrier assembly 115 moves from the first (i.e. locked) position and the second (i.e. unlocked) position.

According to some embodiments, the ramping surface 230 and the ramping surface 235 are at an angle of 45 digress with respect to a bore axis A of the barrel 15 shown in FIG. 17*a*.

It is to be understood that the upper receiver assembly 10 described above may be implemented on different types of firearms. The upper receiver assembly 10 described above may be implemented on firearms using a blowback system of operation, and/or firearm using a direct impingement system of operation, and/or firearm using piston system of operation. Blowback is a system of operation for self-loading firearms that obtains energy from the motion of the cartridge case as it is pushed to the rear by expanding gas crated by the ignition of the propellant charge. Direct impingement is a type of gas operation for a firearm that directs gas from a fired cartridge directly into the bolt carrier to cycle the action. Piston system uses gas pressure to mechanically move the bolt carrier to cycle the action. It is also to be understood that the upper receiver assembly 10 described above may be implemented on M-16 and Armalite style rifles (ARs).

It is to be understood that the upper receiver assembly 10 described above may be coupled to any existing lower receivers known in the art. It is to be understood that any existing lower receivers known in the art can be shot without a stock using the upper receiver assembly 10 described above. It is to be understood that any existing lower receivers known in the art can be shot with a stock in a folded position using the upper receiver assembly 10 described above.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . ."

What is claimed is:

1. An upper receiver assembly of a firearm, the upper receiver assembly comprising:

a barrel;

an extension block removably coupled with the barrel;

an upper receiver removably coupled with the extension block;

a handguard mounting block removably coupled with the barrel; and a handguard removably coupled with the handguard mounting block; wherein the handguard mounting block comprises an aperture configured to accommodate a gas block.

2. The upper receiver assembly of claim 1, wherein the upper receiver is coupled to a lower receiver to form a firearm that can be fired without a stock.

3. The upper receiver assembly of claim 1, wherein the handguard mounting block is removably coupled directly to the barrel.

* * * * *